US012209790B2

(12) United States Patent
Kim et al.

(10) Patent No.: US 12,209,790 B2
(45) Date of Patent: Jan. 28, 2025

(54) REFRIGERATOR

(71) Applicant: LG Electronics Inc., Seoul (KR)

(72) Inventors: Kihwang Kim, Seoul (KR); Sunghee Kang, Seoul (KR); Sangho Jung, Seoul (KR); Yonghyeon Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/159,875

(22) Filed: Jan. 27, 2021

(65) Prior Publication Data

US 2021/0239383 A1 Aug. 5, 2021

(30) Foreign Application Priority Data

Feb. 4, 2020 (KR) ..... 10-2020-0013013
Feb. 4, 2020 (KR) ..... 10-2020-0013014

(51) Int. Cl.
*F25D 17/08* (2006.01)
*F25D 17/06* (2006.01)
(Continued)

(52) U.S. Cl.
CPC ..... *F25D 17/08* (2013.01); *F25D 17/062* (2013.01); *F25D 17/067* (2013.01); *F25D 21/14* (2013.01);
(Continued)

(58) Field of Classification Search
CPC ..... F25D 17/08; F25D 17/062; F25D 17/067; F25D 21/14; F25D 23/028; F25D 2317/062; F25D 2317/0672
See application file for complete search history.

(56) References Cited

U.S. PATENT DOCUMENTS

2008/0256964 A1* 10/2008 Lee ..... F25D 17/065 62/187
2018/0112905 A1* 4/2018 Cho ..... F25D 17/062
2018/0187944 A1* 7/2018 Park ..... F25D 19/04

FOREIGN PATENT DOCUMENTS

EP 2789948 A1 * 10/2014 ..... F25D 23/061
EP 3163231 5/2017
(Continued)

OTHER PUBLICATIONS

Translated_Kim (Year: 2019).*
(Continued)

*Primary Examiner* — Elizabeth J Martin
*Assistant Examiner* — Samba N Gaye
(74) *Attorney, Agent, or Firm* — Fish & Richardson P.C.

(57) ABSTRACT

A refrigerator includes: an evaporator provided in a storage space and configured to supply cold air to the storage space, a duct assembly provided above the evaporator and configured to guide the cold air supplied to the storage space, a door supply duct coupled to the duct assembly and configured to guide a part of the cold air flowing through the duct assembly to a door, and a fan motor assembly coupled to a lower end of the duct assembly and configured to suction air cooled by the evaporator and blow the suctioned air into the duct assembly. The duct assembly defines a first passage and a second passage that are spaced apart from each other, where the second passage includes a main passage configured to supply the cold air to the storage space and a sub-passage branched from the main passage and coupled to the door supply duct.

19 Claims, 21 Drawing Sheets

(51) Int. Cl.
*F25D 21/14* (2006.01)
*F25D 23/02* (2006.01)

(52) U.S. Cl.
CPC ..... *F25D 23/028* (2013.01); *F25D 2317/062* (2013.01); *F25D 2317/0672* (2013.01)

(56) References Cited

FOREIGN PATENT DOCUMENTS

| | | | | | |
|---|---|---|---|---|---|
| EP | 3505852 | | | 7/2019 | |
| KR | 2000019916 | A | * | 4/2000 | |
| KR | 100850959 | B1 | * | 8/2008 | |
| KR | 20090020398 | A | * | 2/2009 | |
| KR | 1020170082084 | | | 7/2017 | |
| KR | 2013589 | B1 | * | 8/2019 | ..... F25D 17/08 |
| WO | WO-2019193651 | A1 | * | 10/2019 | |

OTHER PUBLICATIONS

Translated_Bae (Year: 2008).*
Translated_Park (Year: 2009).*
Translated_Nishigai (Year: 2019).*
Translated_Makoto (Year: 2014).*
Translated_Song (Year: 2000).*
EP Extended European Search Report in European Appln. No. 21155117.1, dated Jun. 21, 2021, 7 pages.
Office Action in European Appln. No. 21155117.1, mailed on Apr. 6, 2023, 5 pages.

* cited by examiner

REFRIGERATOR

CROSS-REFERENCE TO RELATED APPLICATIONS

The present disclosure claims priority to and the benefit of Korean Patent Application No. 10-2020-0013013, filed on Feb. 4, 2020, and Korean Patent Application No. 10-2020-0013014, filed on Feb. 4, 2020, which are hereby incorporated by reference in their entirety.

TECHNICAL FIELD

The present disclosure relates to a refrigerator.

BACKGROUND

A refrigerator is a home appliance for storing foods at a low temperature in a storage space that is covered by a door. To this end, the refrigerator is configured to cool the storage space by using cold air generated through heat exchange with a refrigerant circulating through a refrigeration cycle to store foods in an optimum state.

Recently, the refrigerator has become increasingly multi-functional with changes of dietary lives and gentrification of products, and refrigerators having various structures and convenience devices for convenience of users and for efficient use of internal spaces have been introduced.

In order to cool the storage space of the refrigerator uniformly and effectively, an evaporator is provided inside the refrigerator, and a fan motor for blowing cold air generated by the evaporator and a cold air duct for guiding air blown by the fan motor can be provided.

A conventional refrigerator can include an evaporator, a fan motor, and a duct structure for supplying cold air to a storage space. In some examples, cold air in the conventional refrigerator is distributed to both sides of a rear surface of the storage space and inside of the refrigerator is cooled through a discharge port.

However, the conventional refrigerator may not have a structure for differentially supplying cold air to a duct structure on both sides.

Therefore, a structure in which a door storage space opened or closed by a separate door is provided in the door of the refrigerator and cold air is supplied to a separate storage space has been developed. However, there is a problem that both the storage space and the separate door storage space cannot be effectively cooled.

SUMMARY

The present disclosure is directed to a refrigerator capable of effectively cooling both a storage space and a separate door storage space provided in a door.

According to one aspect of the subject matter described in this application, a refrigerator includes a cabinet defining a storage space, a door configured to open or close the storage space, an evaporator provided in the storage space and configured to supply cold air to the storage space, a duct assembly provided above the evaporator, extending in a vertical direction, and configured to guide the cold air supplied to the storage space, a door supply duct coupled to the duct assembly and configured to guide a part of the cold air flowing through the duct assembly to be supplied to the door, and a fan motor assembly that is coupled to a lower end of the duct assembly and that is configured to suction air cooled by the evaporator and blow the suctioned air into the duct assembly. The duct assembly can define a first passage and a second passage that are spaced apart from each other. The second passage can include a main passage configured to supply the cold air to the storage space, and a sub-passage branched from the main passage and coupled to the door supply duct, where, based on the cold air being supplied to the second passage, a flow rate of the cold air supplied through the second passage can be greater than a flow rate of the cold air supplied through the first passage.

Implementations according to this aspect can include one or more of the following features. For example, a volume of the first passage can be less than a volume of the second passage.

In some implementations, the door can include a main door that is configured to rotate to open or close the storage space, that defines an opening, and that includes a door accommodation member defining a door storage space accessible through the opening, and a sub-door provided in front of the main door and configured to rotate to open or close the opening, where a rear end of the door supply duct can be coupled to the sub-passage, and a front end of the door supply duct can be in communication with the door accommodation member in a state in which the main door is closed.

In some examples, the door supply duct can be provided on an upper surface of the storage space. In some examples, the first passage and the second passage can be respectively disposed on a left side and a right side with respect to a center of the storage space, and the second passage can face the door accommodation member.

In some implementations, the fan motor assembly can include a blowing fan configured to suction cold air in an axial direction and discharge the suctioned air in a circumferential direction, a front housing defining a front surface of the fan motor assembly and including an inlet corresponding to the blowing fan and through which cold air is introduced, and a rear housing coupled to the front housing to define a rear surface of the fan motor assembly and defining (i) a first space in which a fan module is accommodated and (ii) a second space configured to guide cold air toward the duct assembly.

In some examples, the refrigerator further includes a rear cover that defines a rear wall surface of the storage space, that includes a suction port and a discharge port through which cold air passes, and that is configured to shield the evaporator, the fan motor assembly, and the duct assembly, where the rear cover can be spaced apart from the inlet. In some examples, a heat insulation material can be disposed on a rear surface of the rear cover facing the inlet.

In some implementations, the front housing and the rear housing can be coupled to each other and can include a first guide part coupled to the first passage and configured to guide cold air discharged from the blowing fan to the first passage, and a second guide part coupled to the second passage and configured to guide cold air discharged from the blowing fan to the second passage. In some examples, the first guide part can extend upward from an upper side of the blowing fan, and the second guide part can extend laterally and upward from one side of left and right sides of the blowing fan facing the second passage.

In some examples, the blowing fan can be disposed at a lower end of the fan motor assembly and can be configured to rotate in a direction in which the discharged cold air passes through the first guide part and the second guide part. In some implementations, a width of an inlet of the second guide part can be greater than a diameter of the blowing fan, and a width of an inlet of the first guide part can be less than the width of the inlet of the second guide part.

In some implementations, an upper end of the fan motor assembly can include a first housing outlet that defines an opened upper surface of the first guide part and that is coupled to an opened lower end of the first passage, and a second housing outlet that defines an opened upper surface of the second guide part and that is coupled to an opened lower end of the second passage, where an area of the second housing outlet can be greater than an area of the first housing outlet.

In some implementations, the refrigerator can further include a bottom hole defined in the fan motor assembly and opened toward the evaporator such that defrost water is discharged, and a discharge guide extending obliquely from a first side of the bottom hole and covering a part of the bottom hole. In some examples, a drain pan configured to discharge the defrost water to the outside of the storage space can be provided on a bottom surface of the storage space, and the discharge guide can extend toward the drain pan.

In some examples, the discharge guide can extend in a direction opposite to a rotation direction of a blowing fan provided in the fan motor assembly. In some implementations, the bottom hole can be located below and between left and right ends of a blowing fan provided in the fan motor assembly.

In some implementations, the fan motor assembly can define a bottom hole that is opened toward the evaporator such that defrost water is discharged, a discharge guide extending obliquely downward to guide the defrost water discharged through the bottom hole can be provided at a first end of the bottom hole, and the discharge guide can extend from one end of the bottom hole that is closer to the second guide part between both ends of the bottom hole. In some examples, the discharge guide can extend obliquely in a direction away from the second guide part as the discharge guide extends downward.

In some implementations, the bottom hole and the discharge guide can be located at a position closer to the second guide part compared to the first guide part with respect to a vertical extension line passing through the center of the blowing fan.

DETAILED DESCRIPTION

Figure 1:
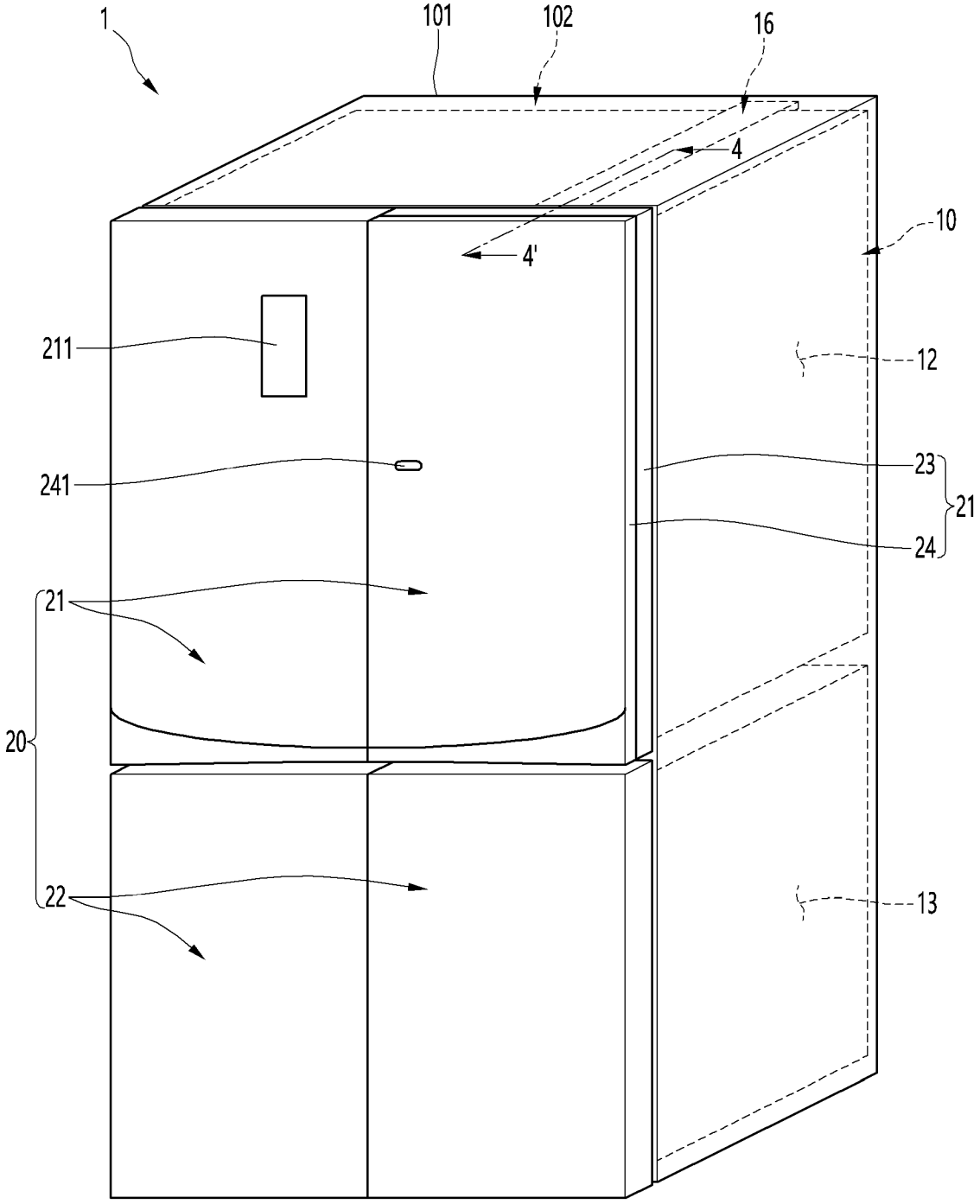
FIG. 1 is a diagram illustrating a perspective view of an exemplary refrigerator.
Figure 2:
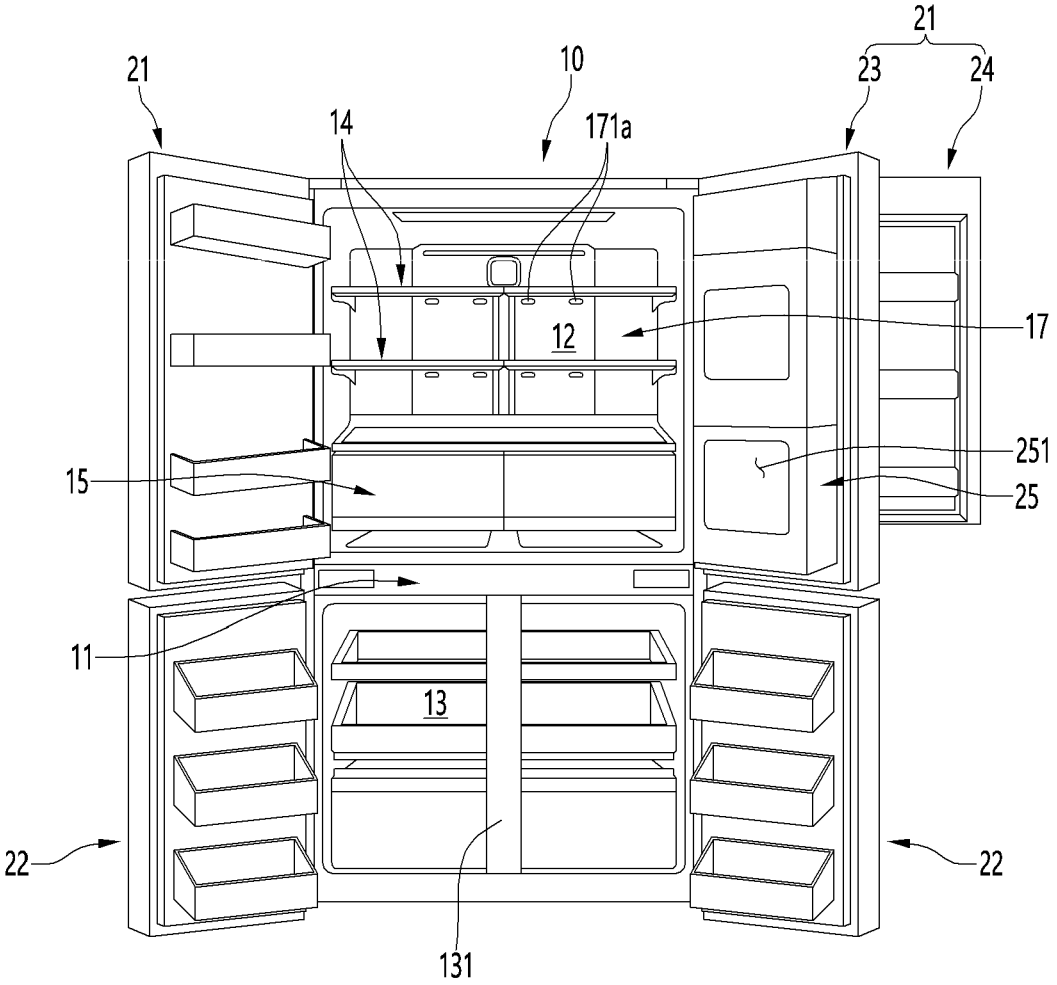
FIG. 2 is a diagram illustrating a front view of the exemplary refrigerator in which a door is opened.
Figure 3:
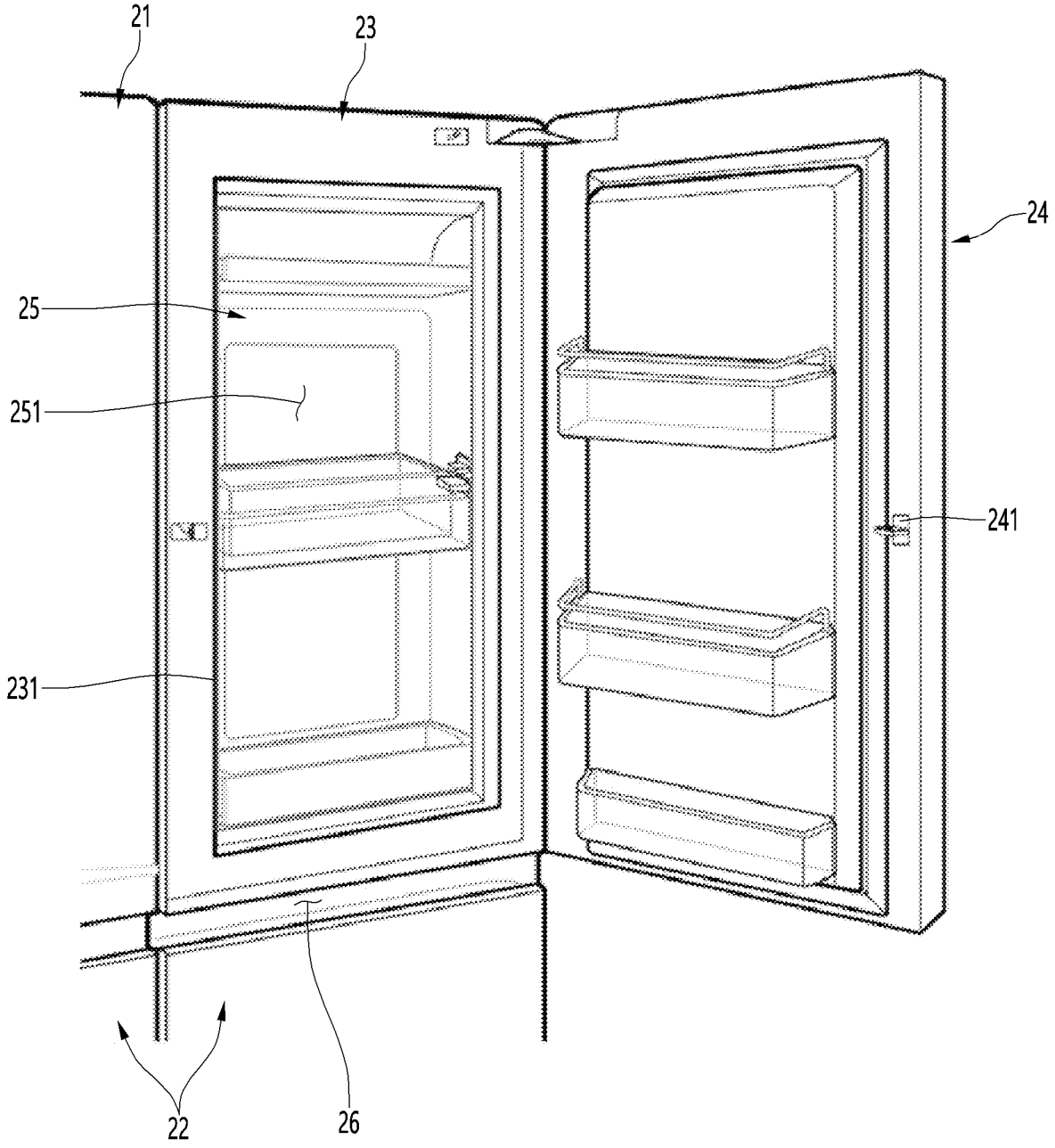
FIG. 3 is a diagram illustrating a partial perspective view of the exemplary refrigerator in which a door storage space is opened.
Figure 4:
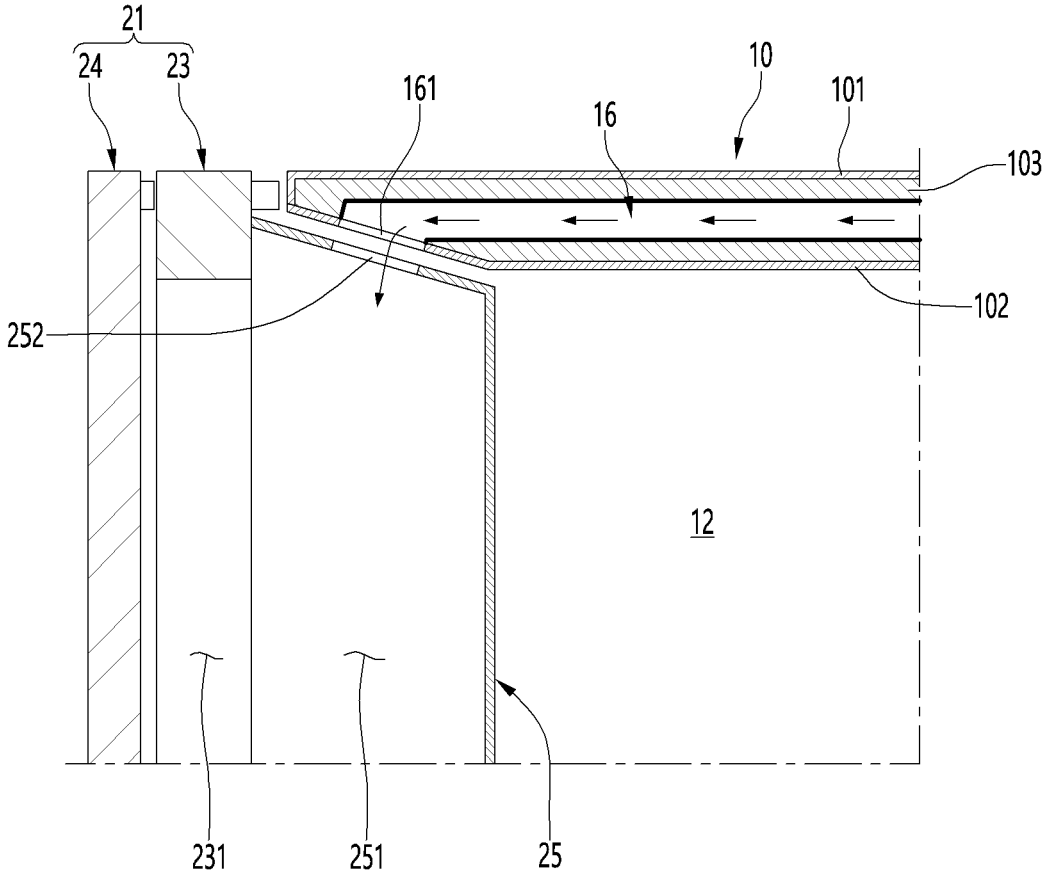
FIG. 4 is a diagram illustrating a cross-sectional view taken along line 4-4' of FIG. 1.

FIG. 1 is a diagram illustrating a perspective view of an exemplary refrigerator. FIG. 2 is a diagram illustrating a front view of the exemplary refrigerator in which a door is opened. FIG. 3 is a diagram illustrating a partial perspective view of the exemplary refrigerator in which a door storage space is opened. FIG. 4 is a diagram illustrating a cross-sectional view taken along line 4-4' of FIG. 1.

Referring to FIGS. 1-4, a refrigerator 1 can include a cabinet 10 in which a storage space is defined, and a door 20 that opens or closes an opened front side of the storage space.

The cabinet 10 can include an outer case 101 defining an outer appearance, and an inner case 102 spaced inwardly from the outer case 101 and defining the storage space. A heat insulation material 103 can be filled between the outer case 101 and the inner case 102.

The storage space can be vertically partitioned by a barrier 11 and can include a refrigerating compartment 12 disposed above and a freezing compartment 13 disposed below. The refrigerating compartment 12 can refer to an upper storage space, and the freezing compartment 13 can refer to a lower storage space. Accommodation members including a plurality of shelves 14 and drawers 15 can be disposed in the refrigerating compartment 12 and the freezing compartment 13.

The freezing compartment 13 can be opened or closed by a pair of freezing compartment doors 22. The freezing compartment doors 22 can be rotatably mounted on the front of the cabinet 10, and can be rotated to open or close the freezing compartment 13. The freezing compartment doors 22 can be provided to have the same size on both left and right sides and can be configured to independently open or close the left and right sides of the freezing compartment 13. Since the freezing compartment door 22 is provided below, the freezing compartment door 22 can be referred to as a lower door.

The freezing compartment 13 can further include a vertical barrier 131 to partition the freezing compartment 13 into left and right sides. The freezing compartment 13 partitioned into left and right sides can be independently opened or closed by the pair of freezing compartment doors 22.

The refrigerating compartment 12 can be opened or closed by a pair of refrigerating compartment doors 21. The refrigerating compartment doors 21 can be rotatably mounted on the front of the cabinet 10, and can be rotated to open or close the refrigerating compartment 12. The refrigerating compartment doors 21 can be provided to have the same size on both left and right sides and can be configured to independently open or close the left and right sides of the refrigerating compartment 12. Since the refrigerating compartment door 21 is provided above, the refrigerating compartment door 21 can be referred to as an upper door.

In some implementations, a display 211 can be provided on one of the pair of refrigerating compartment doors 21. The display 211 can display an operating state of the refrigerator 1.

The other of the pair of refrigerating compartment doors 21, that is, the right door, can be configured as a pair of double-overlaid doors, and such a door can be referred to as a door-in-door (DID).

For example, the refrigerating compartment door 21 can include a main door 23 and a sub-door 24. The main door 23 can open or close the refrigerating compartment 12, and a door storage space 251 accessible from the opened front can be defined therein. The sub-door 24 can be provided in the front side of the main door 23 to open or close the door storage space 251. In some implementations, the main door 23 and the sub-door 24 can be axially coupled by a hinge device so as to rotate in the same direction.

An opening 231 passing through the main door 23 can be defined in the front side of the main door 23. The main door 23 can include a door accommodation member 25 that is accessible through the opening 231 and defines the door storage space 251. The door accommodation member 25 can protrude from the rear surface of the main door 23, that is, the surface facing the inside of the refrigerating compartment 12.

Figure 6:
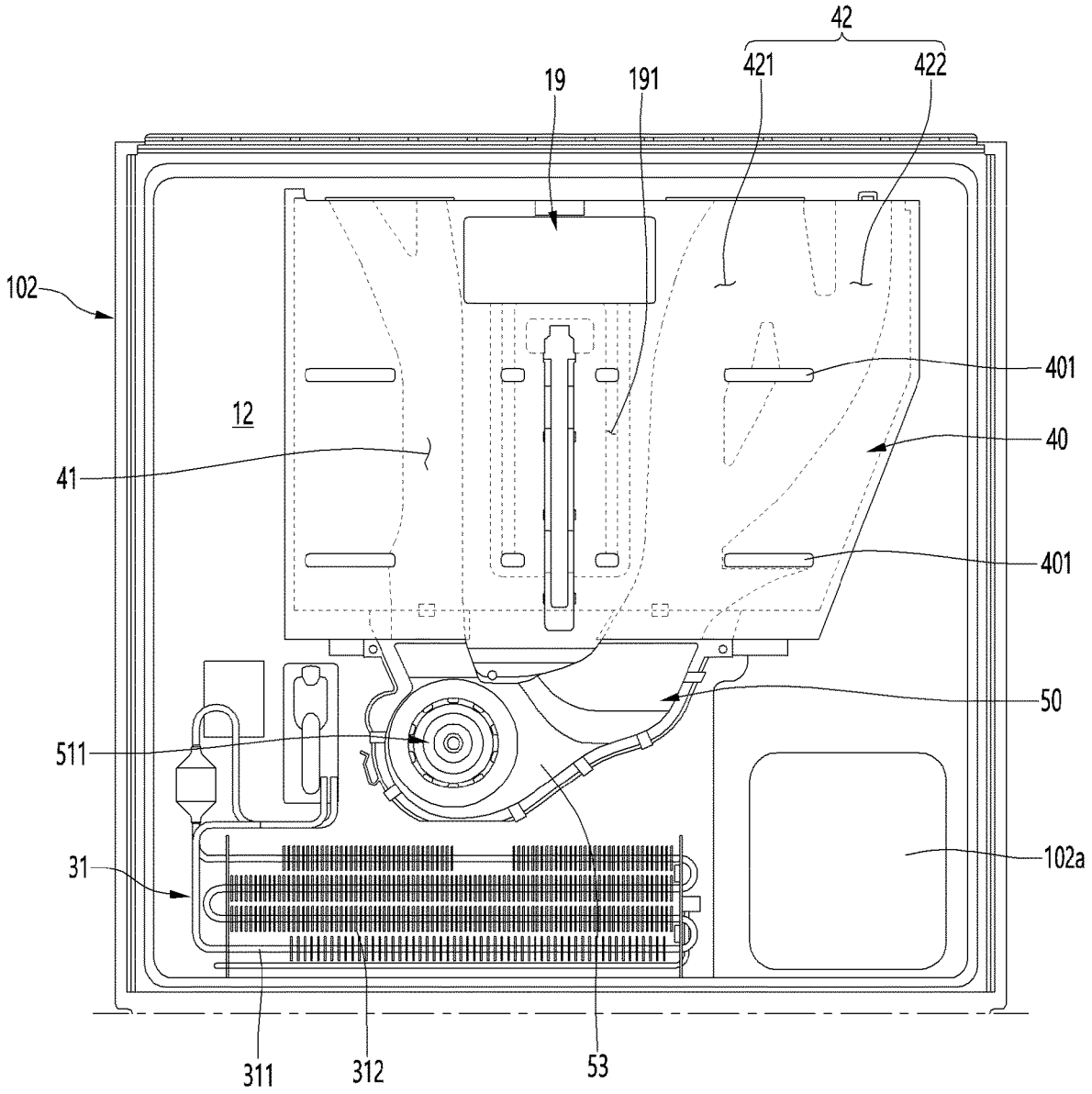
FIG. 6 is a diagram illustrating a front view of a state in which a rear cover of an upper storage space of the exemplary refrigerator is removed.
Figure 7:
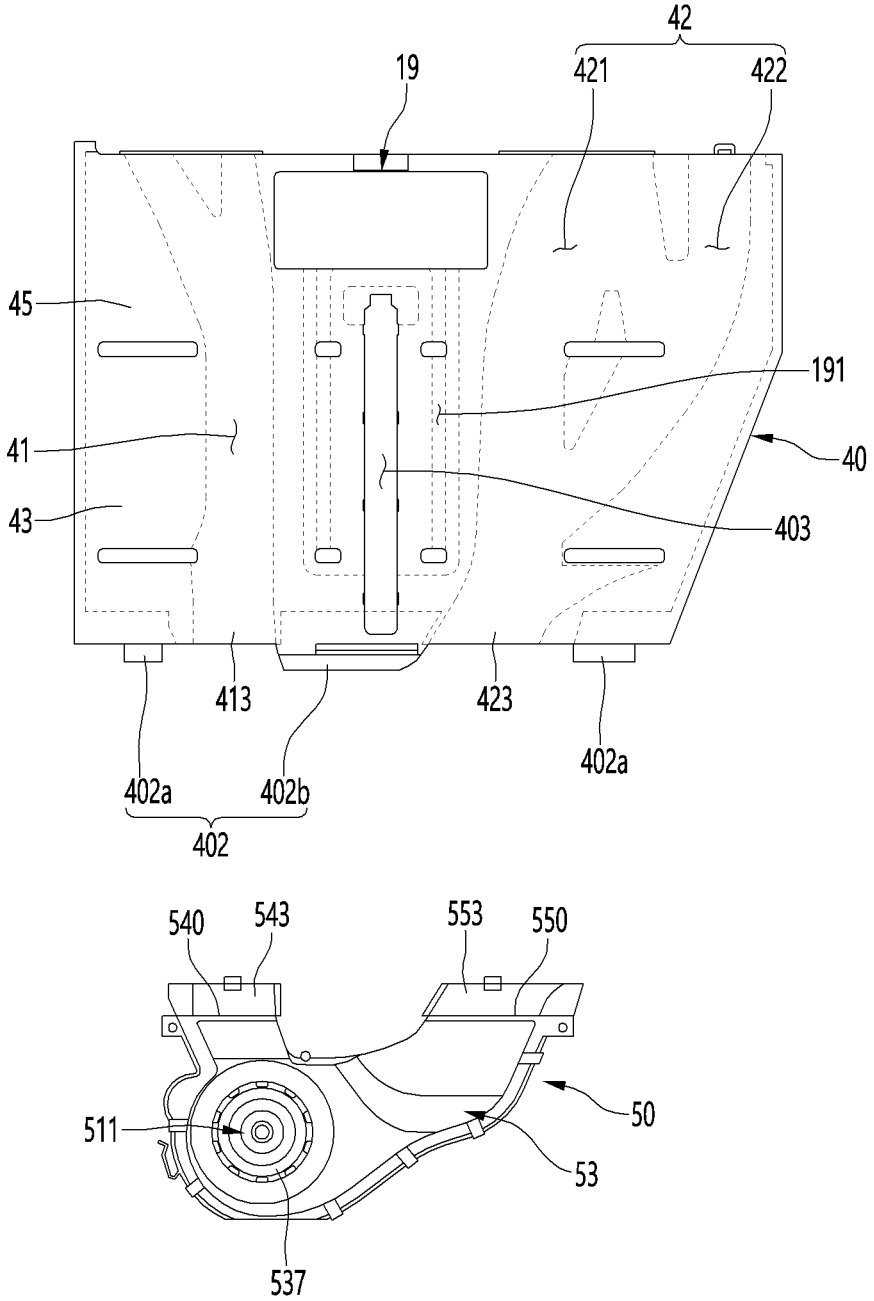
FIG. 7 is a diagram illustrating a view of a state in which an exemplary duct assembly and an exemplary fan motor assembly are separated.

An accommodation member opening 252 through which cold air is introduced can be defined on the upper surface of the door accommodation member 25. The accommodation member opening 252 can be located at a position facing the refrigerating compartment opening 161 opened on the upper surface of the refrigerating compartment 12. A door supply duct 16 for supplying cold air to the door storage space 251 can be coupled to the refrigerating compartment opening 161. The door supply duct 16 can be provided on the outer upper surface of the inner case 102, and can extend from the upper front end to the rear end of the inner case 102. For example, the door supply duct 16 can couple the door storage space 251 to a duct assembly 40, such that cold air guided by the duct assembly 40 can be independently supplied through the door supply duct 16 to the door storage space 251. The duct assembly 40 is depicted in FIGS. 6 and 7, and will be described later in detail.

In some implementations, the sub-door 24 can be provided to have the same width as that of the front side of the main door 23. When the sub-door 24 is closed, the sub-door 24 can be provided to be viewed integrally with the main door 23.

The sub-door 24 can include a door opening device 241. When the door opening device 241 is operated, the sub-door 24 can be opened to expose the door storage space 251. The main door 23 can be rotated while holding a handle 26 at the lower end of the main door 23. For example, the main door 23 and the sub-door 24 can be rotated together.

In some implementations, the refrigerating compartment 12 can include a rear cover 17 defining a rear wall of the refrigerating compartment 12. A plurality of cold air discharge ports 171*a* for supplying cold air to the refrigerating compartment can be defined in the rear cover 17.

The cold air discharge ports 171*a* can have a structure that communicates with the duct assembly 40, and cold air flowing through the duct assembly 40 can be directed toward the inside of the refrigerating compartment 12. The duct assembly 40 can be shielded by the rear cover 17, and a structure in which the duct assembly 40 and the rear cover 17 are coupled to each other can be referred to as a multi-duct.

Figure 5:
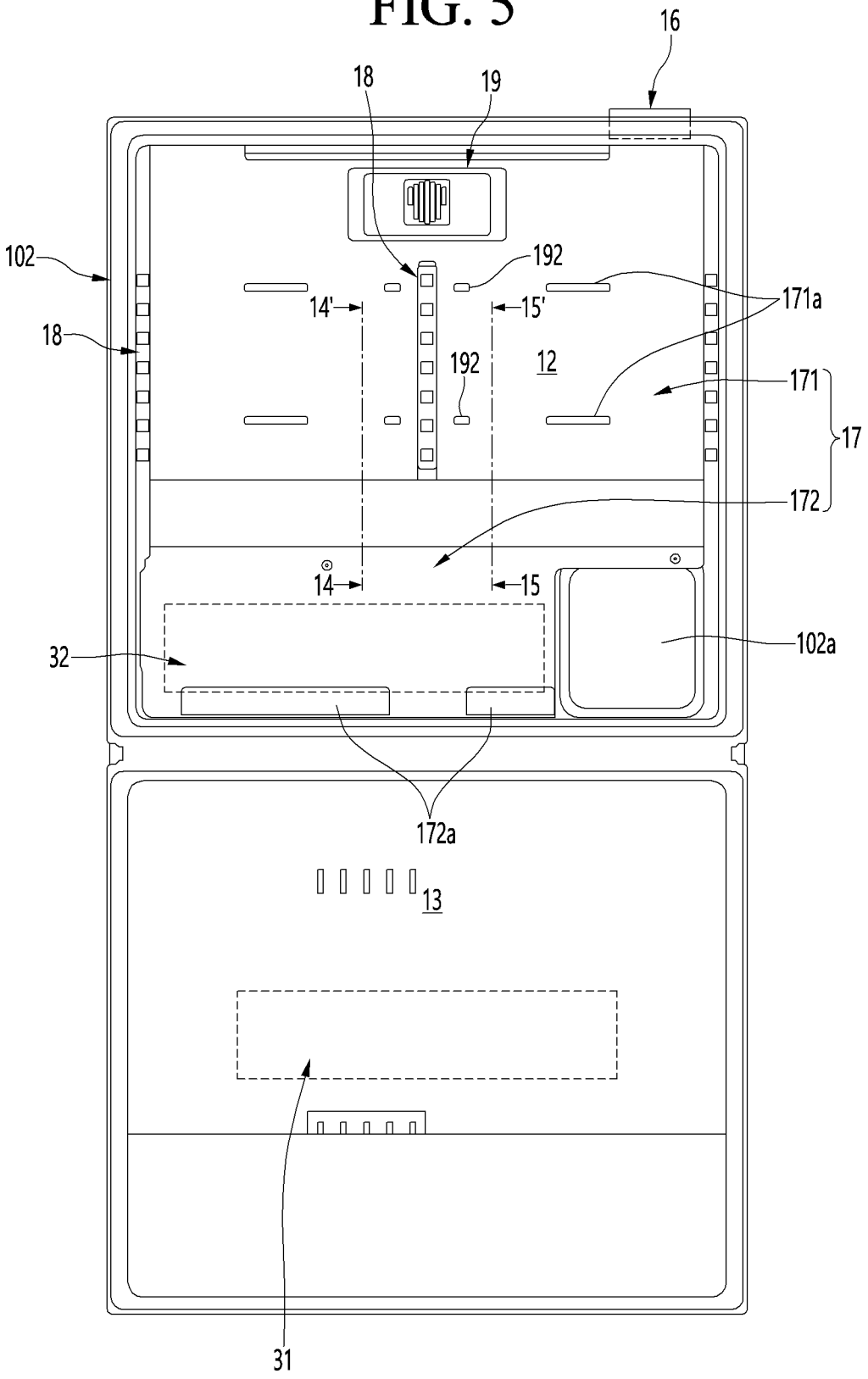
FIG. 5 is a diagram illustrating a front view of the inside of a cabinet of the exemplary refrigerator.
Figure 8:
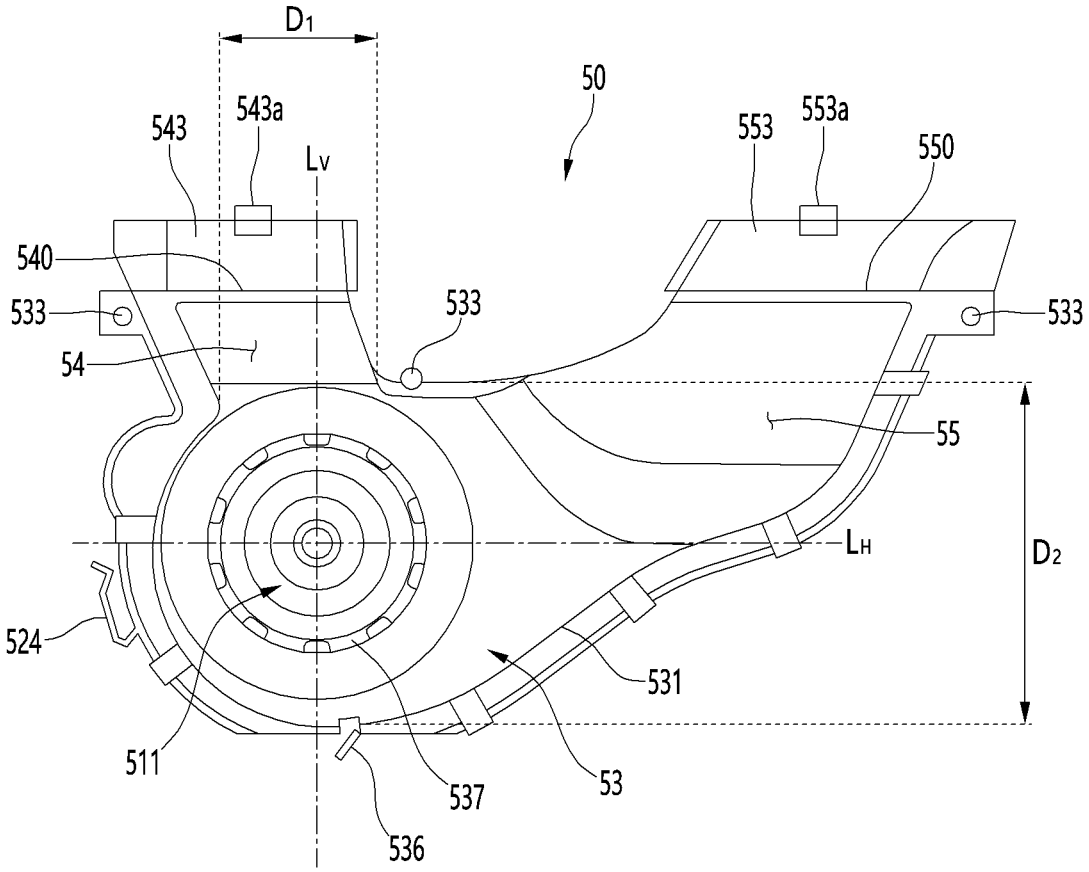
FIG. 8 is a diagram illustrating a front view of the exemplary fan motor assembly of FIG. 7.

FIG. 5 is a diagram illustrating a front view of the inside of the cabinet of the refrigerator 1. FIG. 6 is a diagram illustrating a front view of a state in which the rear cover of the upper storage space of the refrigerator is removed. FIG. 7 is a diagram illustrating a view of a state in which the duct assembly and the fan motor assembly are separated. FIG. 8 is a diagram illustrating a front view of the fan motor assembly.

Referring to FIGS. 5-8, the refrigerating compartment 12 and the freezing compartment 13 can have a structure that is independently cooled by the upper evaporator 32 and the lower evaporator 31, respectively. The upper evaporator 32 and the lower evaporator 31 can have a structure that is shielded by the rear covers 17 defining the rear wall surfaces of the refrigerating compartment 12 and the freezing compartment 13, respectively. The refrigerating compartment 12 and the freezing compartment 13 can have an independent cold air circulation structure.

The structure of the refrigerating compartment 12, that is, the upper storage space, is described as an example for convenience and understanding of description, but the present disclosure is not limited thereto. The present disclosure is applicable to refrigerators of any structures that can supply the cold air generated by the evaporator using the fan motor assembly and the duct assembly.

The evaporator 31 can be provided at the inner lower portion of the refrigerating compartment 12. The evaporator 31 can be located at one side closer to the left space between the left and right spaces of the refrigerating compartment 12 that is skewed to the left. A PCB accommodation part 102*a* protruding forward can be provided at the right side of the evaporator 31. The PCB accommodation part 102*a* can be opened from the rear side so as to be accessible from the rear surface of the cabinet 10, and can provide a space in which a main PCB for controlling the operation of the refrigerator 1 is installed. For example, in the PCB accommodation part 102*a*, the rear surface of the inner case 102 can be recessed forward. The evaporator 31 can located in a space between the PCB accommodation part 102*a* and the left wall surface of the refrigerating compartment 12.

Figure 19:
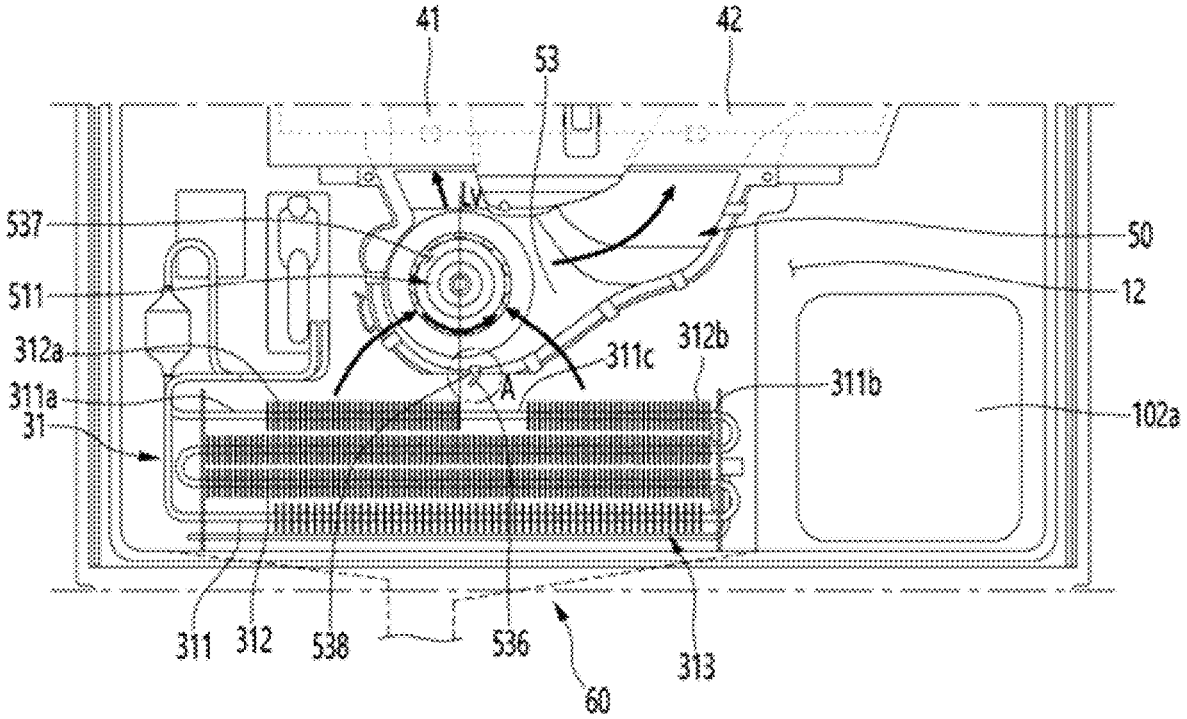
FIG. 19 is a diagram illustrating a structure of air flow and defrost water discharge of the fan motor assembly.

The evaporator 31 can be provided for cooling the refrigerating compartment 12 and a fin-type heat exchanger can be used. For example, the evaporator 31 can include (i) a refrigerant pipe 311 that extends in the horizontal direction and is repeatedly bent a plurality of times to allow the refrigerant to flow therein and (ii) a plurality of cooling fins 312 through which the refrigerant pipe 311 passes and which are continuously disposed along the refrigerant pipe 311. Referring to FIG. 19, in some examples, an upper part of the refrigerant pipe 311 can be located below the fan motor assembly 50. The upper part of the refrigerant pipe 311 can include a first portion 311*a* that faces the first guide part 54 and passes through first fins 312*a* among the plurality of cooling fins 312, a second portion 311*b* that faces the second guide part 55 and passes through second fins 312*b* among the plurality of cooling fins 312, and a third portion 311*c* that is located between the first portion 311*a* and the second portion 311*b* and faces the discharge guide 536, where the third portion 311*c* passes through none of the plurality of cooling fins 312.

The space in which the evaporator 31 and the fan motor assembly 50 are provided can be shielded by the lower rear cover 172 to define a space. Therefore, air that has passed through the evaporator 31 can be introduced through the fan motor assembly 50.

In some implementations, an inlet 537 of the fan motor assembly 50 can be located above the evaporator 31, and can be disposed in the center of the evaporator 31 in the horizontal direction. For example, a blowing fan 511 of the fan motor assembly 50 can be disposed at the center of the evaporator 31 in the horizontal direction. When the blowing fan 511 is driven, cold air can flow toward the inlet 537 in the entire region including both left and right sides of the evaporator 31.

The fan motor assembly 50 can be provided above the evaporator 31, and the duct assembly 40 can be provided above the fan motor assembly 50. Cold air introduced from the evaporator 31 through the fan motor assembly 50 can be supplied to the duct assembly 40, and cold air flowing along the duct assembly 40 can be supplied to the refrigerating compartment 12 to cool the refrigerating compartment 12. In some implementations, part of cold air flowing along the duct assembly 40 can be supplied to the door storage space 251 through the door supply duct 16 to cool the door storage space 251.

The upper end of the fan motor assembly 50 can be coupled to the lower end of the duct assembly 40. The fan motor assembly 50 and the duct assembly 40 can be shielded by the rear cover 17 in a state of being mounted on the rear surface of the inner case 102.

The rear cover 17 can be made of a plate-shaped plastic material, and can define the outer appearance of the inner rear wall of the refrigerating compartment 12. The rear cover 17 can include an upper rear cover 171 and a lower rear cover 172. The upper rear cover 171 can be configured to shield the duct assembly 40, and the lower rear cover 172 can be configured to shield the evaporator 31 and the fan motor assembly 50.

The upper rear cover 171 can define the rear wall surface of the upper region in which the shelf 14 disposed in the refrigerating compartment 12 is disposed, and the lower rear cover 172 can define the rear wall surface of the lower region in which the drawer 15 disposed inside the refrigerating compartment 12 is disposed.

The lower rear cover 172 can protrude further forward than the upper rear cover 171 so as to secure a space in which the evaporator 31 is disposed and secure a space for inflow of cold air into the fan motor assembly 50.

A suction port 172*a* through which air inside the refrigerating compartment 12 is suctioned can be provided at the lower end of the lower rear cover 172. The suction port 172*a* can be located at a position corresponding to the lower end of the evaporator 31, such that the suctioned air can be cooled while passing through the evaporator 31 in the process of flowing into the fan motor assembly 50.

A plurality of cold air discharge ports 171*a* communicating with the duct assembly 40 can be defined in the upper rear cover 171. The cold air discharge ports 171*a* can be defined at positions corresponding to the plurality of shelves 14 provided in the refrigerating compartment 12. The cold air discharge ports 171*a* can be provided on the left and right sides, and can overlap at least part of a first passage 41 and a second passage 42 of the duct assembly 40 and communicate with each other. The cold air discharge port 171*a* can be further provided at the upper end of the upper rear cover 171.

A shelf rail 18 for mounting the shelf 14 can be mounted at the center of the upper rear cover 171. The shelf rail 18 can extend vertically, and a plurality of mounting holes can be defined to adjust the height of the shelf. The shelf rail 18 can be further provided on both sides of the rear wall of the refrigerating compartment 12, such that the rear ends of the shelf 14 can be stably supported from both sides.

An air purification device 19 can be further provided at the upper center of the upper rear cover 171. The air purification device 19 can be provided for purifying air inside the refrigerating compartment 12. In some examples, a fan, a motor, a filter, and a gas sensor can be provided inside. When a component that may cause an odor in the refrigerating compartment 12 is detected, the fan, the motor, the filter, and the gas sensor can be operated such that air inside the refrigerating compartment 12 is suctioned and discharged to continuously purify the air inside the refrigerating compartment 12. To this end, air purification passages 191 can be defined on both sides of the center of the duct assembly 40, and purified air discharge ports 192 communicating with the air purification passages 191 can be defined in the upper rear cover 171.

The duct assembly 40 can extend from the upper end of the fan motor assembly 50 to the upper end of the refrigerating compartment 12. The duct assembly 40 can be provided to have a size smaller than that of the upper rear cover 171 and can be completely covered by the upper rear cover 171.

The duct assembly 40 can include a rail mounting part 403 in which the shelf rail 18 is provided in the center. Cold air passages 41 and 42 coupled to housing outlets 540 and 550 on the upper surface of the fan motor assembly 50 can be defined in the duct assembly 40. The cold air passages 41 and 42 can refer to a first passage 41 and a second passage 42 provide on left and right sides with respect to the rail mounting part 403.

The first passage 41 and the second passage 42 can extend from the upper end to the lower end of the duct assembly 40, respectively, and the cold air discharged from the fan motor assembly 50 can be guided upward. Duct holes 401 communicating with the cold air discharge ports 171*a* can be opened in the first passage 41 and the second passage 42. The cold air discharge port 171*a* and the duct hole 401 can be provided in the same shape and located at the same position, such that the cold air flowing along the first passage 41 and the second passage 42 can be directed toward the refrigerating compartment 12.

In some implementations, the duct assembly 40 can be made of a heat insulation material as a whole. For example, the duct assembly 40 can be made of a plate-shaped heat insulation material such as compressed STYROFOAM. The duct assembly 40 can include a front plate 43 defining the front surface, a rear plate 44 defining the rear surface, and a passage forming member 45 defining the first passage 41 and the second passage 42 between the front plate 43 and the rear plate 44. In some implementations, at least part of the front plate 43, the rear plate 44, and the passage forming member 45 can be integrally provided.

The first passage 41 can define a passage for guiding cold air to be discharged from the rear left side with respect to the center of the refrigerating compartment 12, and the second passage 42 can define a passage for guiding cold air to be discharged from the rear right side with respect to the center of the refrigerating compartment 12.

In some implementations, the second passage 42 can be coupled to the door supply duct 16 to further guide cold air to the door storage space 251. For example, the flow rate of the cold air supplied through the second passage 42 can be greater than the flow rate of the cold air supplied through the first passage 41. Therefore, the second passage 42 can have a volume greater than that of the first passage 41, and can have inlet and outlet areas greater than those of the first passage 41.

The second passage 42 can be branched into a main passage 421 for supplying cold air to the refrigerating compartment 12, and a sub-passage 422 coupled to the door supply duct 16 to supply cold air to the door storage space 251. The sub-passage 422 can be located closer to the side than the main passage 421, and can be provided to have an independent outlet at the upper end of the duct assembly 40.

In some implementations, a duct protrusion 402 protruding downward can be provided at the lower end of the duct assembly 40. The duct protrusion 402 can be coupled to the upper end of the fan motor assembly 50 to guide the fan motor assembly 50 to be coupled at an accurate position.

In some implementations, the duct protrusion 402 can include a pair of side protrusions 402*a*, and a central protrusion 402*b* between the side protrusions 402*a*. The pair of side protrusions 402*a* can contact the outer ends of the first housing outlet 540 and the second housing outlet 550 of the fan motor assembly 50 and protrude to be constrained to each other. The central protrusion 402*b* can be provided to be constrained to each other between the first housing outlet 540 and the second housing outlet 550 by contacting the first housing outlet 540 and the second housing outlet 550.

A first stepped part 413 and a second stepped part 423 can be provided at the lower ends of the first passage 41 and the second passage 42. The first stepped part 413 and the second stepped part 423 can be provided to have shapes corresponding to a first coupling part 543 and a second coupling part 553 extending upward from the upper ends of the first housing outlet 540 and the second housing outlet 550, respectively. For example, when the upper end of the fan motor assembly 50 and the lower end of the duct assembly 40 are coupled to each other, the first coupling part 543 and the second coupling part 553 can be inserted into the first stepped part 413 and the second stepped part 423.

In some implementations, the stepped height of the first stepped part 413 and the second stepped part 423 can be provided to correspond to the thickness of the first coupling part 543 and the second coupling part 553, such that the inner surfaces of the first housing outlet 540 and the second housing outlet 550 and the inner surfaces of the first flow passage 41 and the second flow passage 42 extend in the same plane, thereby achieving smooth flow of cold air.

The fan motor assembly 50 can be configured such that the blowing fan 511 is provided therein to suction air from the evaporator 31 and then guide the air to the duct assembly 40. The fan motor assembly 50 can be opened such that the inlet 537 faces forward, and can be located at the center of the evaporator 31. For example, the inlet 537 can be provided closer to the first passage 41 than the second passage 42 with respect to the left and right direction.

The first housing outlet 540 and the second housing outlet 550 can be defined at the upper end of the fan motor assembly 50 by the branched passages. The first housing outlet 540 and the second housing outlet 550 can communicate with the first passage 41 and the second passage 42 of the duct assembly 40. For example, the air suctioned into the inlet 537 by the blowing fan 511 passes through the first housing outlet 540 and the second housing outlet 550 and can be supplied to the insides of the first passage 41 and the second passage 42.

Hereinafter, the structure of the fan motor assembly 50 will be described in more detail with reference to the drawings.

Figure 9:
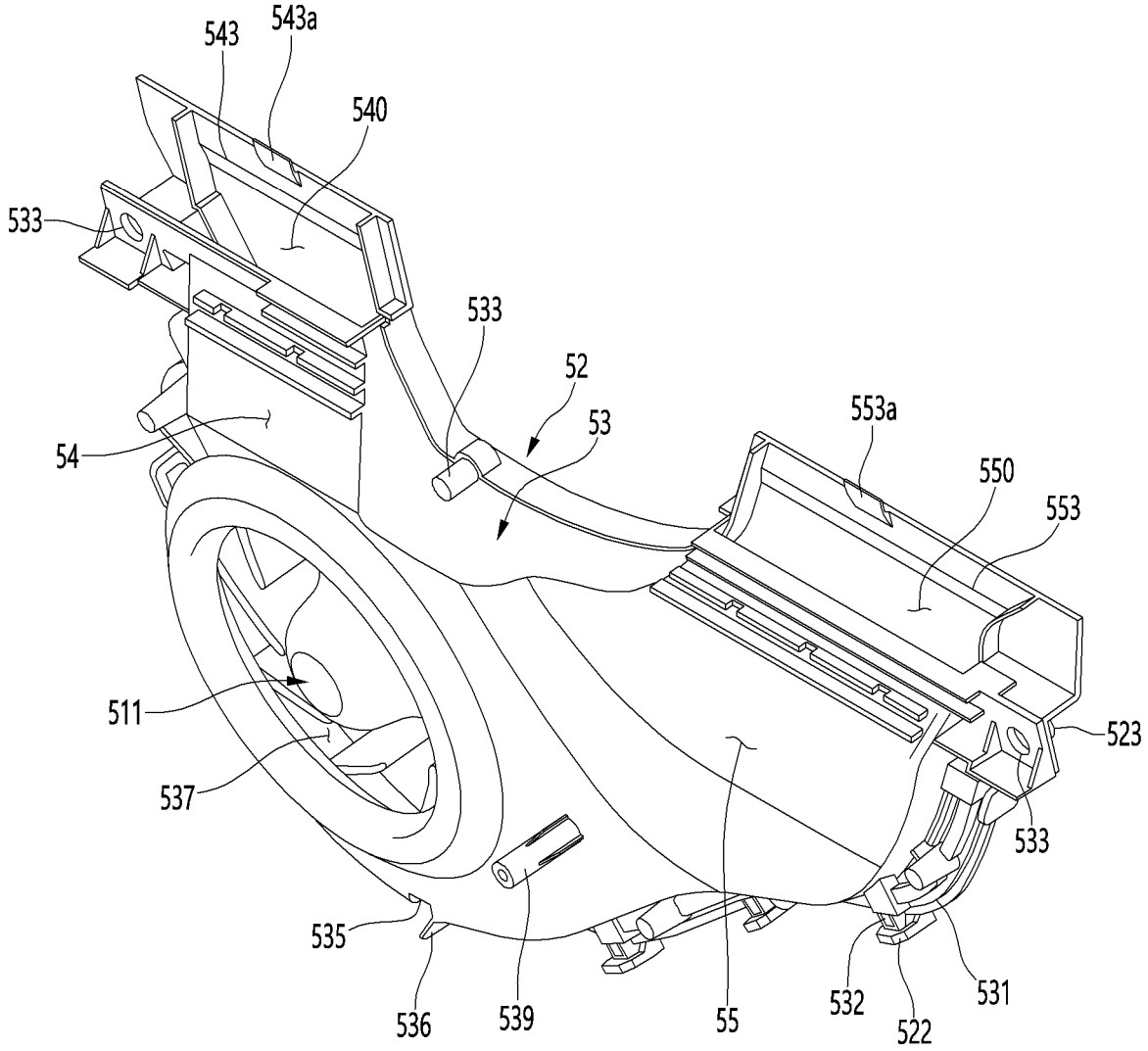
FIG. 9 is a diagram illustrating a perspective view of the exemplary fan motor assembly seen from above.
Figure 10:
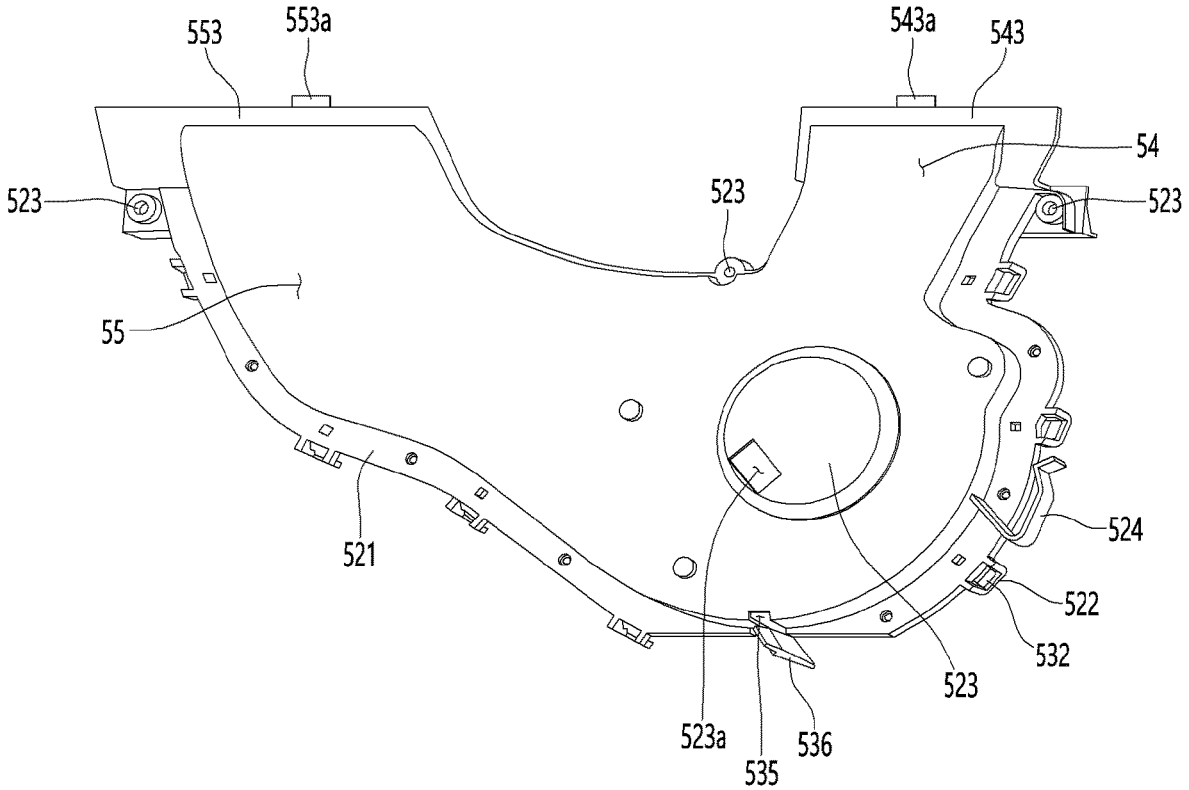
FIG. 10 is a diagram illustrating a perspective view of the exemplary fan motor assembly seen from the rear.
Figure 11:
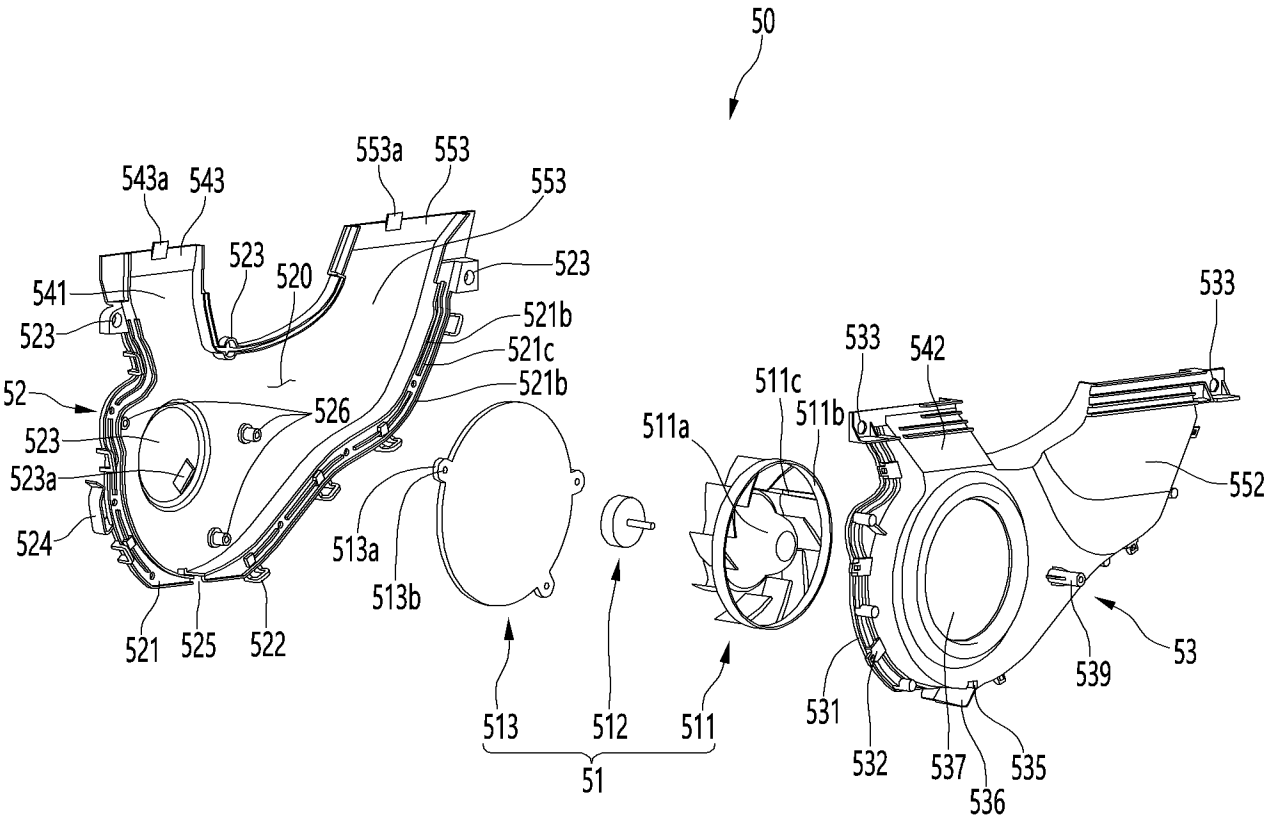
FIG. 11 is a diagram illustrating an exploded perspective view of the exemplary fan motor assembly seen from the front.
Figure 12:
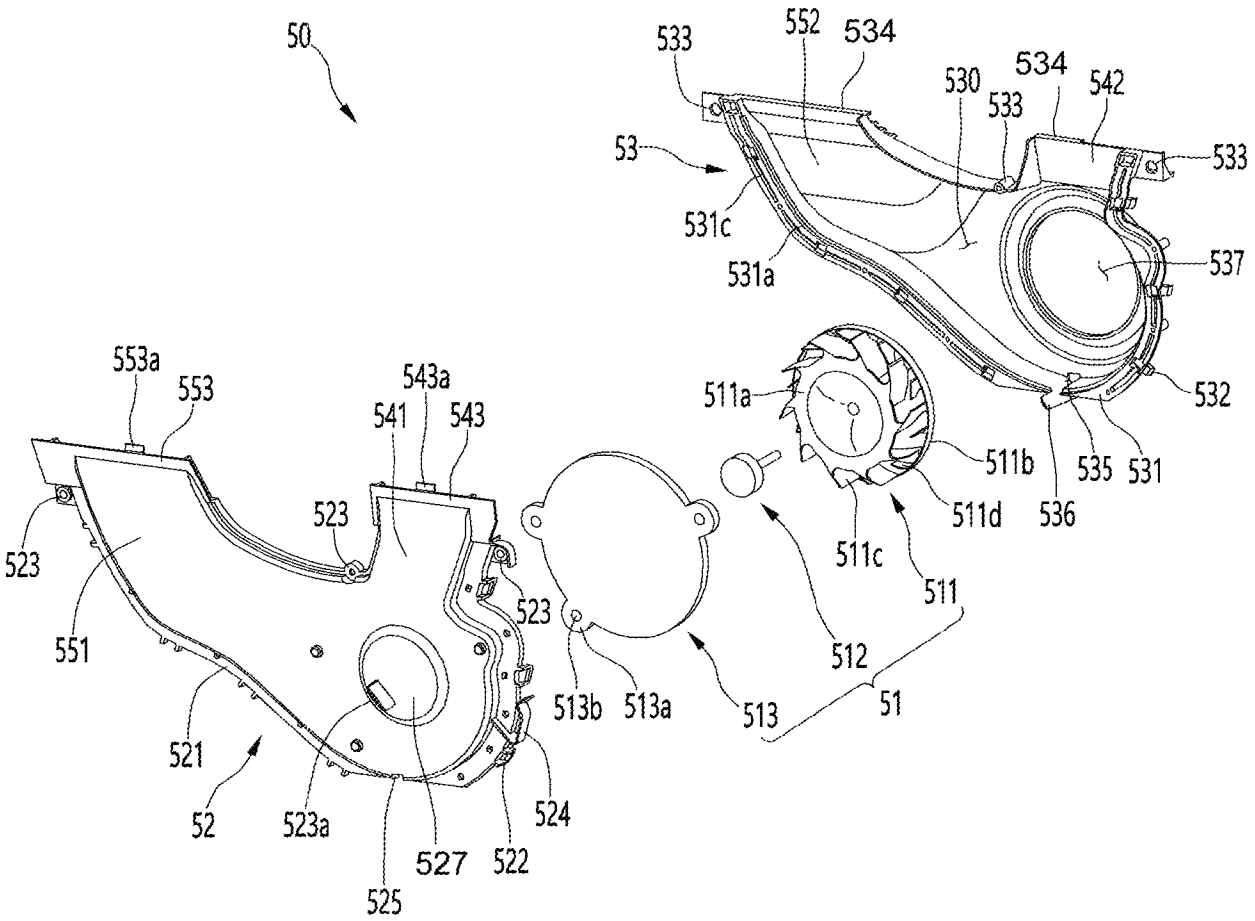
FIG. 12 is a diagram illustrating an exploded perspective view of the exemplary fan motor assembly seen from the rear.
Figure 13:
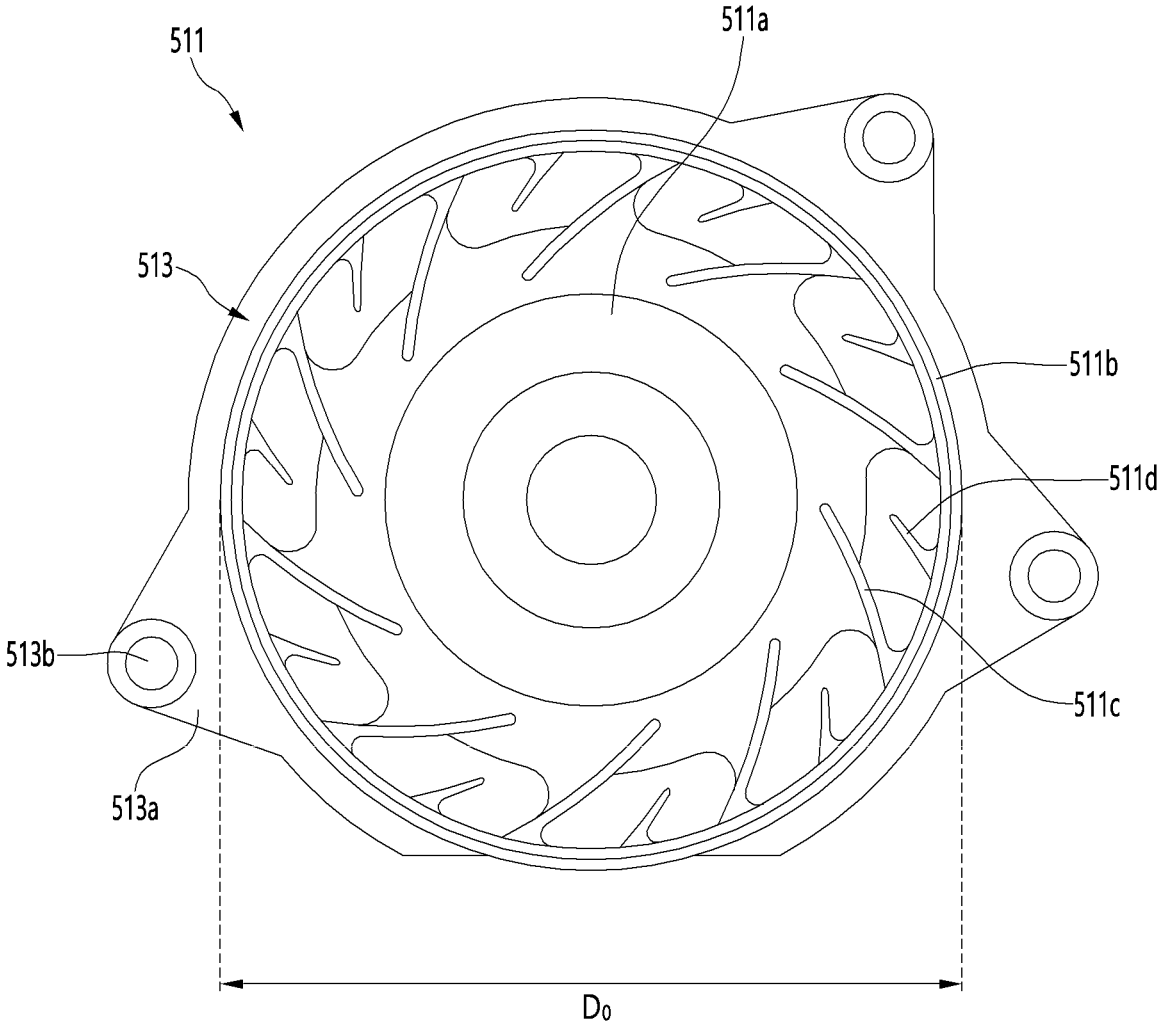
FIG. 13 is a diagram illustrating a front view of an exemplary fan module.

FIG. 9 is a diagram illustrating a perspective view of the fan motor assembly 50 seen from above. FIG. 10 is a diagram illustrating a perspective view of the fan motor assembly 50 seen from the rear. FIG. 11 is a diagram illustrating an exploded perspective view of the fan motor assembly 50 seen from the front. FIG. 12 is a diagram illustrating an exploded perspective view of the fan motor assembly 50 seen from the rear. FIG. 13 is a diagram illustrating a front view of the fan module.

Referring to FIGS. 9-13, the fan motor assembly 50 can include a fan module 51 that rotates, and a front housing 53 and a rear housing 52 accommodating the fan module 51.

The fan module 51 can include a blowing fan 511 for forcing the flow of air, a motor 512 for rotating the blowing fan 511, and a base plate 513 on which the motor 512 is mounted.

The blowing fan 511 can be a centrifugal fan that suctions air in the axial direction and discharges air in the circumferential direction. The blowing fan 511 can be configured to rotate counterclockwise.

The air suctioned into the fan motor assembly 50 by the counterclockwise rotation of the blowing fan 511 can allow air of a greater flow rate to flow toward the second housing outlet 550. The blowing fan 511 can include a fan base 511*a* having a protruding central portion, a ring-shaped shroud 511*b* spaced forward from the fan base 511*a*, and a plurality of blades 511*c* coupling the front end of the fan base 511*a* to the shroud 511*b*.

The plurality of blades 511*c* can be disposed at regular intervals along the circumference of the fan base 511*a* and can be provided to have a predetermined slope and curvature such that air is suctioned and discharged in the circumferential direction when the blowing fan 511 rotates counterclockwise. An auxiliary blade 511*d* can be provided between the plurality of blades 511*c*. The auxiliary blade 511*d* can be disposed between the adjacent blades 511*c*, and can extend from the shroud 511*b* to the blades 511*c*. The auxiliary blade 511*d* can be provided to have a size smaller than that of the blades 511*c* and can be spaced apart from the fan base 511*a*.

In some implementations, the motor 512 can be fixedly mounted on the base plate 513, and can be accommodated in the recessed inside of the center of the fan base 511*a*. A rotational shaft of the motor 512 can be coupled to the center of the fan base 511*a*. The motor 512 can be accommodated in the inner space of the recessed fan base 511*a* and may not be exposed to the outside.

A plurality of mounting parts 513*a* can protrude outward on the outside of the base plate 513. A mounting hole 513*b* can defined in the mounting part 513*a*, such that the fan module 51 can be fixedly mounted on the inner side of the rear housing 52. A protruding mounting boss 526 can be provided on the inner side of the rear housing 52 corresponding to the mounting hole 513*b*, and the mounting boss 526 can be provided to pass through the mounting hole 513*b*.

In some implementations, the fan module 51 can be fixedly mounted on the rear housing 52. A recessed module mounting part 527 can be provided at one side of the rear housing 52 on which the fan module 51 is mounted. An opening 523*a* can be defined in the module mounting part 527 to allow arrangement and entry of an electric wire coupled to the motor 512.

The upper portion of the rear housing 52 can be branched into two parts toward the first housing outlet 540 and the second housing outlet 550. In some implementations, the rear housing 52 can have a first rear guide part 541 and a second rear guide part 551 extending toward the first housing outlet 540 and the second housing outlet 550. The first rear guide part 541 can extend upward with respect to the module mounting part 527, and can extend to the first housing outlet 540 defined at the upper end of the rear housing 52. The second rear guide part 551 can extend laterally with respect to the module mounting part 527, and can extend to the second housing outlet 550 defined at the upper end of the rear housing 52.

The first coupling part 543 and the second coupling part 553 extending upward can be provided at the upper end of the rear housing 52 corresponding to the first housing outlet 540 and the second housing outlet 550. Constraining protrusions 543*a* and 553*a* further extending upward from the upper ends of the first coupling part 543 and the second coupling part 553 to be locked and constrained by the first stepped part 413 and the second stepped part 423 can be further provided.

The rear housing 52 can define an overall recessed space 520 so as to accommodate the fan module 51 inside and to define an air flow passage. A rear flange 521 extending perpendicular to the recessed direction can be provided along the circumference of the recessed space.

An outer rib 521*a* can be provided around the rear flange 521. The outer rib 521*a* can be provided along the outermost circumferential surface of the rear flange 521 excluding the first housing outlet 540 and the second housing outlet 550.

An inner rib 521*b* can be provided at the inner side spaced apart from the outer rib 521*a*. The inner rib 521*b* can extend while maintaining a predetermined distance from the outer rib 521*a*, and can be provided along the inner end of the rear flange 521.

A middle rib 521*c* can be further provided between the outer rib 521*a* and the inner rib 521*b*. The middle ribs 521*c* can be provided in plurality, and can be continuously disposed along between the outer ribs 521*a* and the inner ribs 521*b*. In some implementations, a gasket made of an elastic material can be further provided along a space among the outer rib 521*a*, the inner rib 521*b*, and the middle rib 521*c*. The gasket can be made of a material such as rubber, silicone, or sponge, and can be compressed when the front housing 53 and the rear housing 52 are coupled to each other. Therefore, it is possible to limit air from leaking along the circumferences of the front housing 53 and the rear housing 52 that are coupled to each other.

In some implementations, a locking part 522 extending forwardly along the outer side of the rear flange 521 can be provided. The locking part 522 can be provided such that the inside is opened and a hook 532 of the front housing 53 is locked and constrained. For example, the front housing 53 and the rear housing 52 can maintain a coupled state.

Rear screw fastening parts 523 can be provided on both upper left and right sides and one central side of the rear housing 52, respectively. The rear screw fastening part can be provided at a position corresponding to a front screw fastening part 533 of the front housing 53, and can be provided to communicate with each other when the front housing 53 and the rear housing 52 are coupled to each other. Therefore, in a state in which the front housing 53 and the rear housing 52 are coupled to each other, a screw passing through the front screw fastening part 533 can be fastened to the rear screw fastening part, such that the front housing 53 and the rear housing 52 can be firmly fixed to each other.

An electric wire fixing part 524 for fixing an electric wire coupled to the motor 512 can be provided at one side of one side surface of the rear housing 52. In some implementations, a rear bottom hole 525 can be defined at the lower end of the rear housing 52. The rear bottom hole 525 can allow water flowing down the inside of the rear housing to be discharged to the outside of the fan motor assembly 50. The rear bottom hole 525 can be located vertically below the center of the blowing fan 511.

The front housing 53 can be provided in a shape corresponding to the rear housing 52, and can be coupled to the rear housing 52 to define a space in which the fan module 51 can be accommodated and a space in which air introduced by the driving of the blowing fan 511 can be guided toward the duct assembly 40.

The front housing 53 can define a space 530 having an opened rear surface and a recessed front surface, thereby defining a space in which the blowing fan 511 can be accommodated and cold air can flow. A front flange 531 extending outward along the recessed circumference of the front housing 53 can be provided. An inner rib groove 531*a* and a middle rib groove 531*c* can be provided in the front flange 531.

The inner rib groove 531*a* can be defined along the inner end of the front flange 531, and can be provided in a shape corresponding to a position at which the inner rib 521*b* can be inserted. The middle rib groove 531*c* can be defined outside the inner rib groove 531*a*, and can be provided in a shape corresponding to a position at which the middle rib 521*c* can be inserted.

For example, when the front housing 53 and the rear housing 52 are coupled to each other, the front flange 531 and the rear flange 521 can be in close contact with each other. In some implementations, the inner rib 521*b* and the middle rib 521*c* can be inserted into the inner rib groove 531*a* and the middle rib groove 531*c*, such that the front housing 53 and the rear housing 52 can be accurately coupled to each other and made to be airtight with each other.

A plurality of hooks 532 can be provided along the outer end of the front flange 531. The hook 532 can be provided at a position corresponding to the locking part 522, and can be provided in a shape of a hook capable of locking and constraining with the locking part 522.

Front screw fastening parts 533 can be provided on both upper left and right sides and the upper center of the front housing 53. For example, after the front housing 53 and the rear housing 52 are coupled to each other, the screw passing through the front screw fastening part 533 and the rear screw fastening part can be fastened to firmly couple the front housing 53 to the rear housing.

In some implementations, the screw can be fastened to the lower end of the duct assembly 40 through the front screw fastening part 533 and the rear screw fastening part, and can firmly couple the fan motor assembly 50 to the duct assembly 40.

A front bottom hole 535 can be defined at a lower end of the front housing 53. The front bottom hole 535 can have a structure coupled to the rear bottom hole 525. A discharge guide 536 can be provided along the front bottom hole 535, such that water in the fan motor assembly 50 can be discharged downward along the discharge guide 536.

The inlet 537 can be defined in the front housing 53. The inlet 537 can be provided to have a size corresponding to the size of the shroud 511*b* of the blowing fan 511, and can be provided to have the same center as the center of the blowing fan 511. The circumference of the inlet 537 can be provided in the shape of a bell mouse, and can be bent toward the inside of the shroud 511*b*.

In some implementations, the fan motor assembly 50 can define a passage directed toward the first housing outlet 540 and the second housing outlet 550 opened upward by the coupling of the front housing 53 and the rear housing 52.

To this end, the front housing 53 can have an upper portion branched to both left and right sides, like the rear housing 52, and can extend toward the first housing outlet 540 and the second housing outlet 550. In some implementations, the upper end of the front housing 53 can be provided lower than the upper end of the rear housing 52. The upper end of the front housing 53 can have a contact part 534 bent forward. When the fan motor assembly 50 and the duct assembly 40 are coupled to each other, the contact part 534 can be in close contact with the lower surface of the duct assembly 40, that is, the inlet circumferential surfaces of the first passage 41 and the second passage 42.

The front housing 53 can have a first front guide part 542 and a second front guide part 552 extending toward the first housing outlet 540 and the second housing outlet 550. The first front guide part 542 can extend upward from the inlet 537, and can be provided to have a slope that decreases toward the first housing outlet 540 opened on the inlet 537 side, such that air discharged in the circumferential direction by the blowing fan 511 is directed toward the first housing outlet 540.

The second front guide part 552 can extend from the right side of the inlet 537 toward the second housing outlet 550. For example, the second front guide part 552 can extend laterally and upward from the inlet 537, or can extend laterally and then extend upward, or can be provided to be inclined or rounded. The second front guide part 552 can be provided such that at least part of the portion extending from the inlet 537 toward the second housing outlet 550 is gradually lowered. In some implementations, air discharged in the circumferential direction by the blowing fan 511 can be directed toward the second housing outlet 550.

The first front guide part 542 and the second front guide part 552 can be provided in a shape corresponding to the first rear guide part 541 and the second rear guide part 551, and the first guide part 54 and the second guide part 55 can be provided by the coupling of the front housing 53 and the rear housing 52. For example, the first guide part 54 can be defined by a space between the first front guide part 542 and the first rear guide part 541, and the second guide part 55 can be defined by a space between the second front guide part 552 and the second rear guide part 551.

The first guide part 54 can be located above the blowing fan 511, and an extension line Lv (see FIG. 8) of the vertical direction passing through the center of the blowing fan 511 can be located inside the region of the first passage 41 and the first guide part 54.

The second guide part 55 can be located at the side of the blowing fan 511, and an extension line of the horizontal direction passing through the center of the blowing fan 511 can be provided to pass through the inlet of the second guide part 55. For example, the inlet of the second guide part 55 can extend in the tangential direction of the rotation direction of the blowing fan 511. A width D2 of the entrance of the second guide part 55 (see FIG. 8) can be greater than a diameter DO (see FIG. 13) of the blowing fan 511, and can extend from the lower end of the fan motor assembly 50 to the upper side of the blowing fan 511. For example, when the blowing fan 511 rotates, the resistance of cold air discharged through the blowing fan 511 in the circumferential direction can be minimized, and the flow rate of cold air supplied to the refrigerating compartment 12 and the door storage space 251 can be secured.

For example, the width D2 of the entrance of the second guide part 55 can be significantly greater than the width D1 of the entrance of the first guide part 54, such that more cold air can be supplied to the second passage 42 than the first passage 41. In some implementations, the first guide part 54 and the second guide part 55 can be sequentially disposed in the rotation direction of the blowing fan 511 based on the lower end of the blowing fan 511, such that cold air can be more smoothly supplied to the second guide part 55.

In some implementations, a support protrusion 539 protruding forward can be further provided on the front surface of the front housing 53. The support protrusion 539 can support the rear cover 17, disposed in the front, from the rear. The support protrusion 539 can be fastened with a screw passing through the rear cover 17, and can stably support the rear cover 17 so as not to flow or deform.

Hereinafter, a state in which the fan motor assembly 50 and the duct assembly 40 are assembled will be described in more detail with reference to the drawings.

Figure 14:
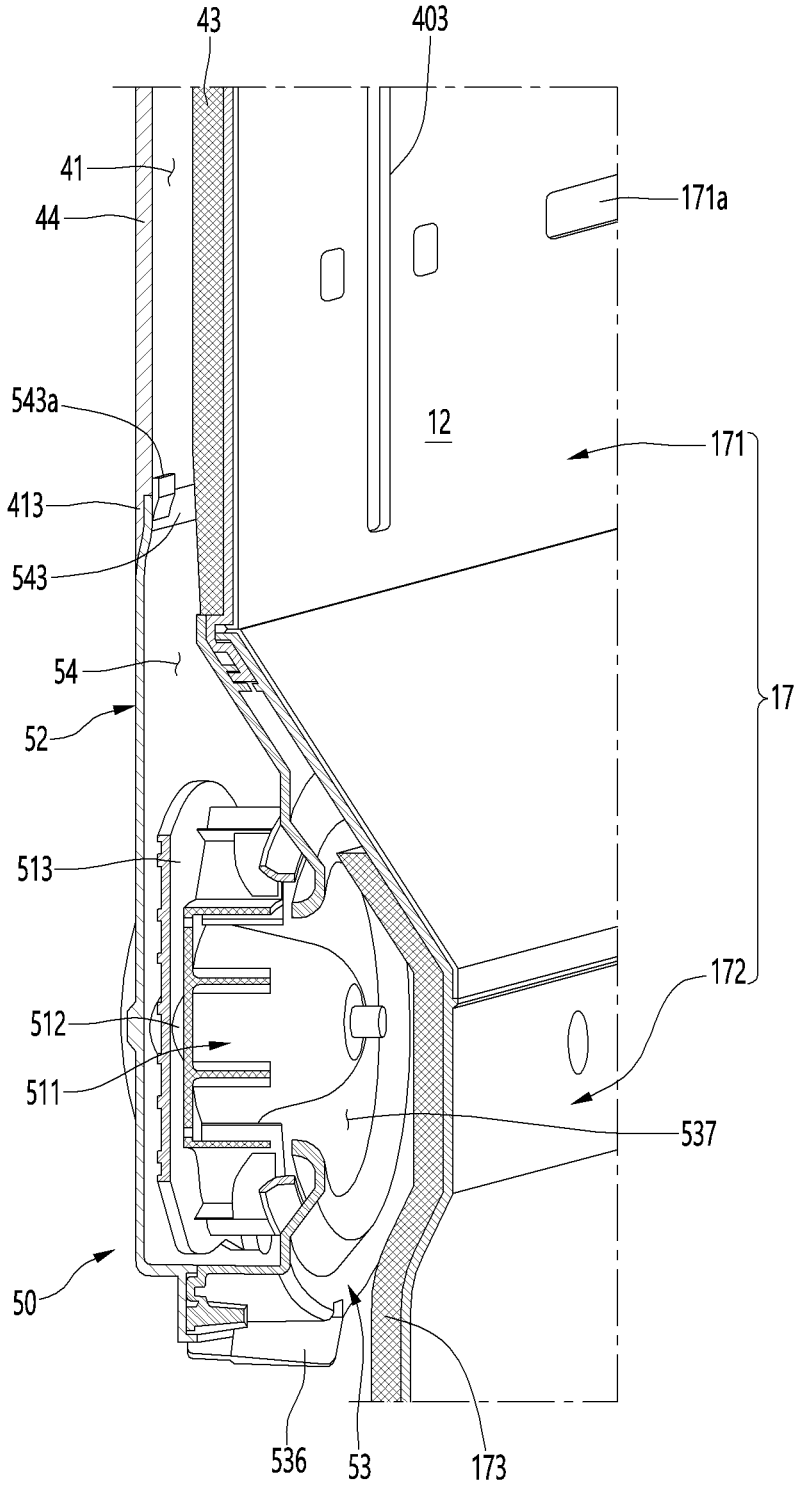
FIG. 14 is a diagram illustrating a cut-away perspective view taken along line 14-14' of FIG. 5.
Figure 15:
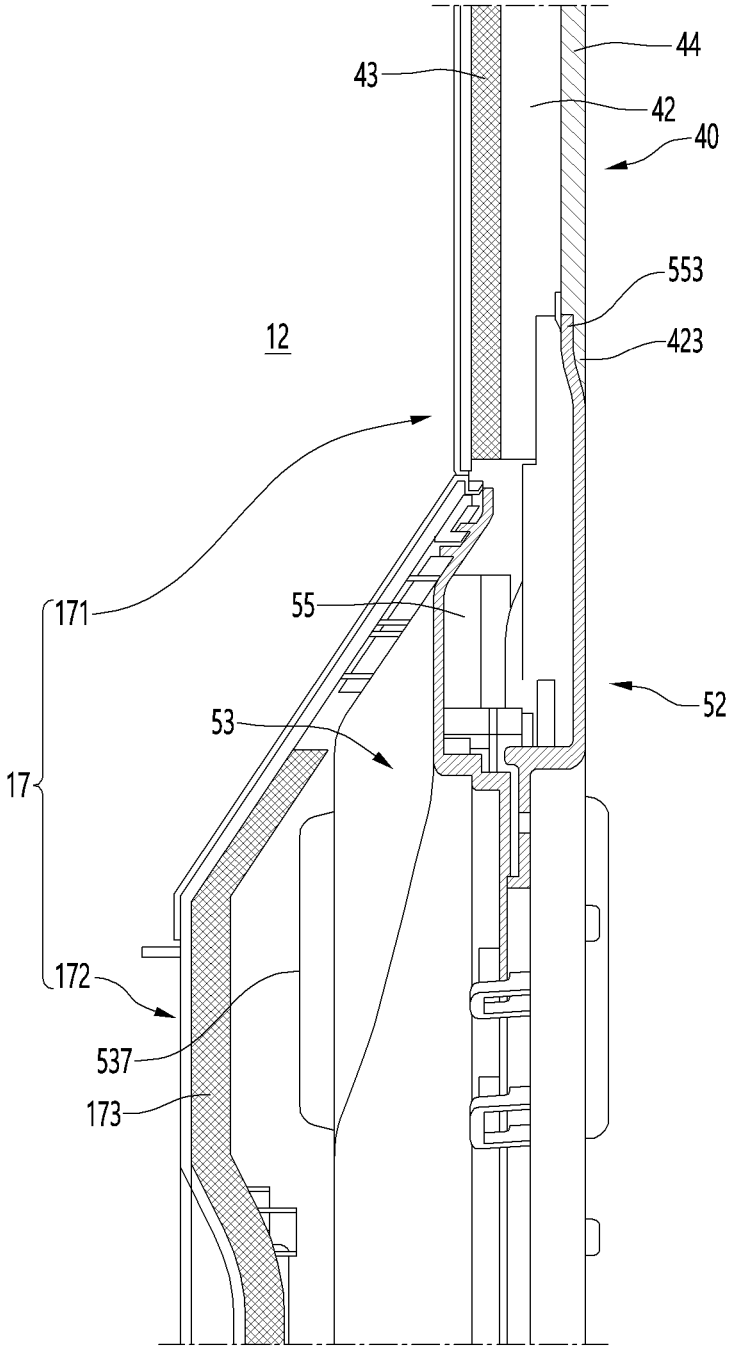
FIG. 15 is a diagram illustrating a cross-sectional view taken along line 15-15' of FIG. 5.

FIG. 14 is a diagram illustrating a cut-away perspective view taken along line 14-14' of FIG. 5. FIG. 15 is a diagram illustrating a cross-sectional view taken along line 15-15' of FIG. 5.

Referring to FIG. 14, the fan motor assembly 50 can be coupled to the lower end of the duct assembly 40. In some implementations, the first housing outlet 540 and the second housing outlet 550 of the fan motor assembly 50 are coupled to the lower ends of the first passage 41 and the second passage 42, respectively, such that air blown from the blowing fan 511 flows.

For example, the first guide part 54 provided in the fan motor assembly 50 can communicate with the first passage 41. In some implementations, the first coupling part 543 provided at the upper end of the fan motor assembly 50 can be seated on the first stepped part 413 provided at the lower end of the duct assembly 40.

The inner surface of the rear housing 52 is generally provided in a flat shape, and the upper end of the first guide part 54 forms the same plane as the inner surface of the first passage 41. In some implementations, cold air discharged in the circumferential direction of the blowing fan 511 by the rotation of the blowing fan 511 can smoothly flow into the first passage 41 through the first guide part 54.

Likewise, the second guide part 55 can also communicate with the second passage 42. The second coupling part 553 provided at the upper end of the fan motor assembly 50 can be seated on the second stepped part 423 provided at the lower end of the duct assembly 40.

The inner surface of the rear housing 52 can be generally provided in a flat shape, and the upper end of the second guide part 55 forms the same plane as the inner surface of the second passage 42. In some implementations, cold air discharged in the circumferential direction of the blowing fan 511 by the rotation of the blowing fan 511 can smoothly flow into the second passage 42 through the second guide part 55.

In some implementations, cold air can flow into the inlet 537 of the fan motor assembly 50 by driving the blowing fan 511. For example, cold air below the fan motor assembly 50 can have a structure flowing into the inlet 537 from the front of the fan motor assembly 50.

Due to this structure, during the process in which cold air flows into the inlet 537, the cold air can be concentrated on the inner surface of the rear cover 17 facing the inlet 537. Due to the concentration of cold air, the temperature of the refrigerating compartment 12 adjacent to the rear cover 17 can be locally lowered, resulting in a problem of supercooling.

Therefore, a heat insulation material 173 can be disposed on the inner surface of the rear cover 17. For example, the heat insulation material 173 can be a vacuum heat insulation material having a small thickness and excellent heat insulation performance. The heat insulation material 173 can be attached to the rear surface of the rear cover 17, and even when cold air is concentrated on a position adjacent to the inlet 537, it is possible to limit the front surface of the rear cover 17 from being supercooled. In some implementations, the heat insulation material 173 can have a sheet structure having a relatively small thickness to sufficiently secure a flowing space for cold air directed toward the inlet 537.

Hereinafter, the flow of cold air inside the storage space having the above structure will be described in more detail with reference to the drawings.

Figure 16:
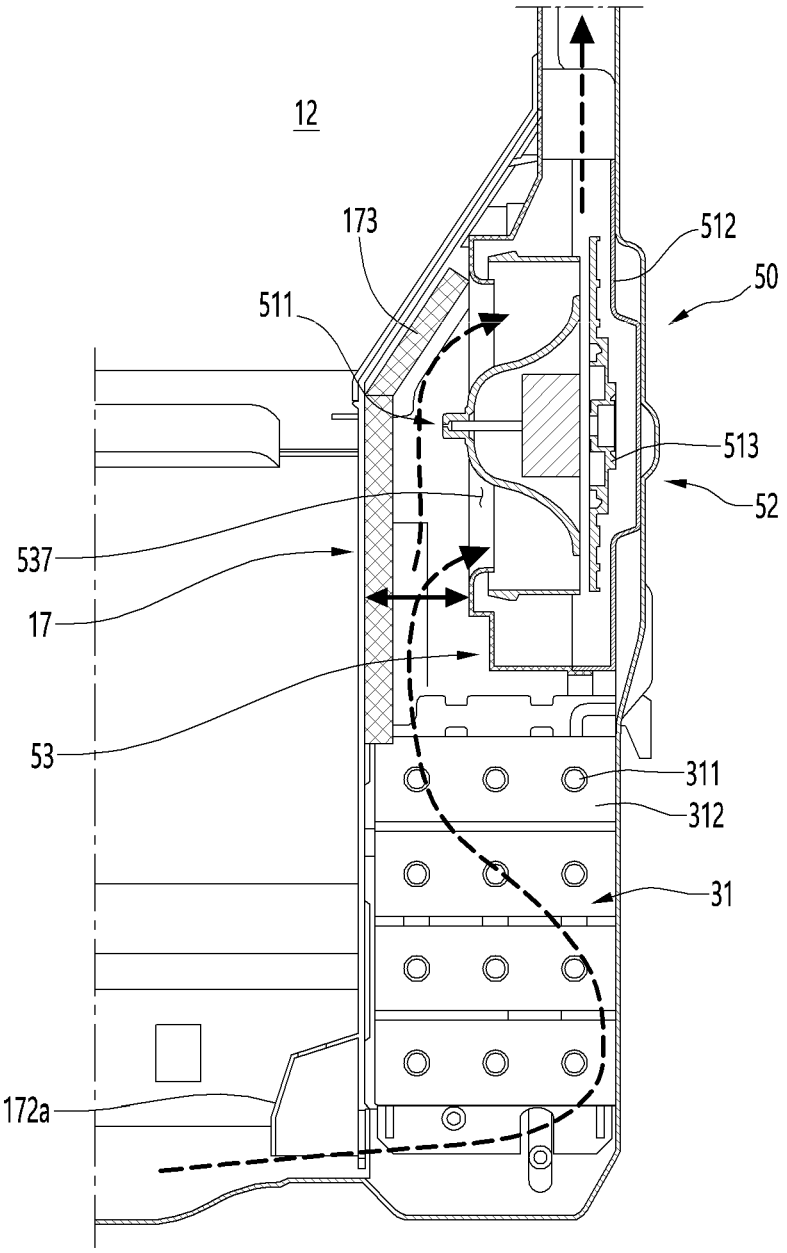
FIG. 16 is a diagram illustrating a view of a flow state of cold air in an evaporator and a fan motor assembly.
Figure 17:
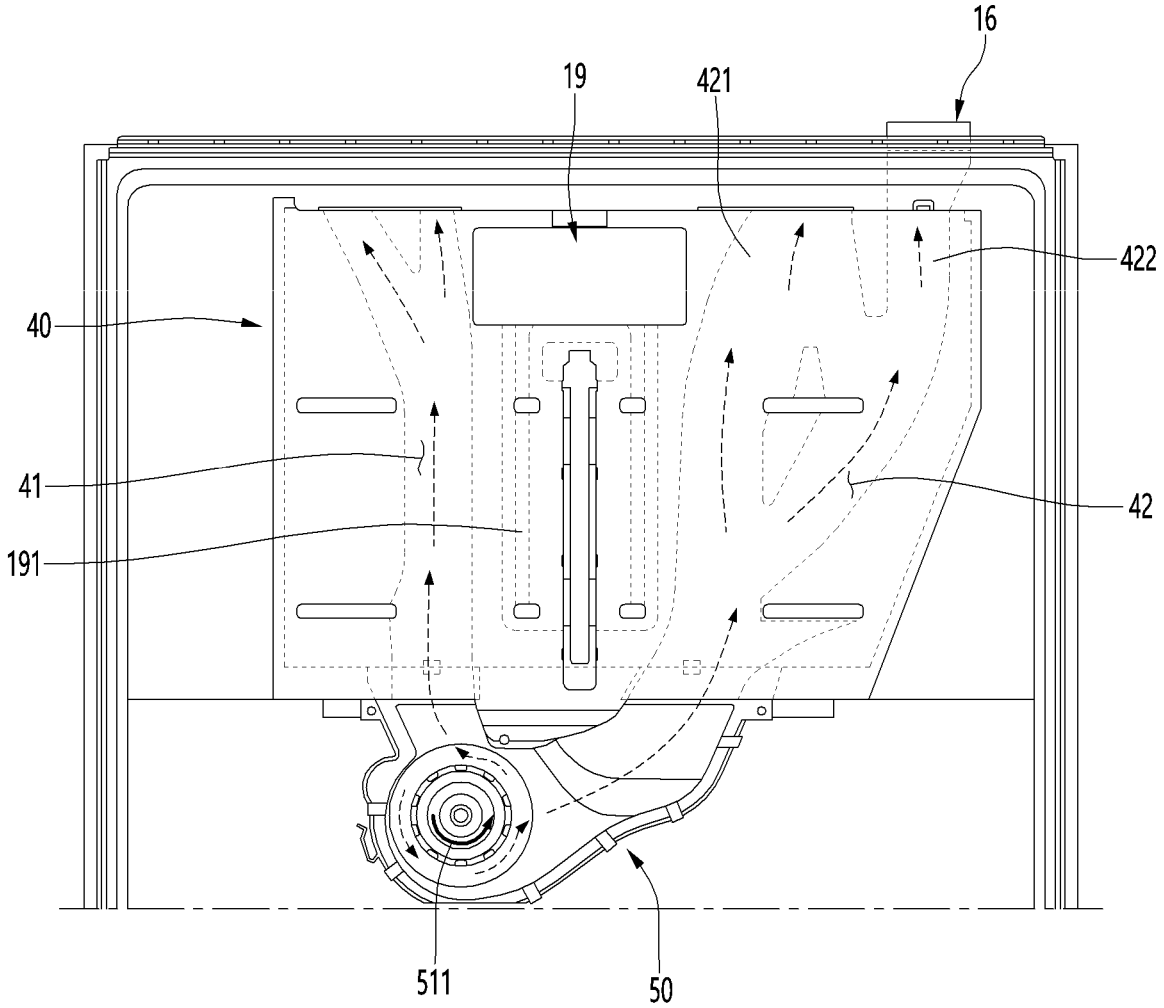
FIG. 17 is a diagram illustrating a view of the flow of cold air in the fan motor assembly and the duct assembly.
Figure 18:
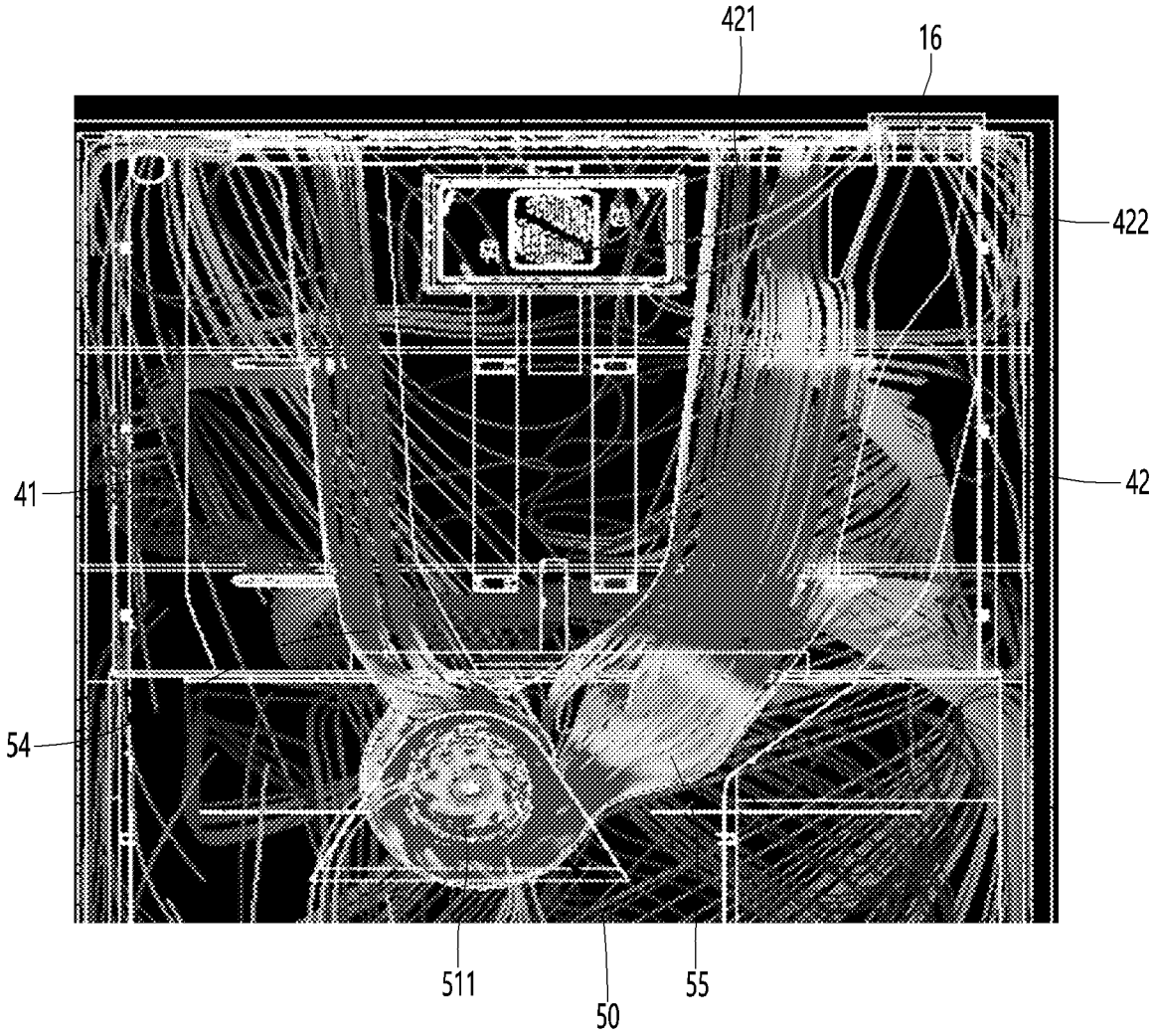
FIG. 18 is a simulation diagram illustrating a flow state of cold air in the upper storage space.

FIG. 16 is a diagram illustrating a view of a flow state of cold air in the evaporator and the fan motor assembly. FIG. 17 is a diagram illustrating a view of the flow of cold air in the fan motor assembly and the duct assembly. FIG. 18 is a simulation diagram showing a flow state of cold air in the upper storage space.

Referring to FIG. 16, the blowing fan 511 can be driven so as to cool the refrigerating compartment 12. When the blowing fan 511 rotates, air inside the refrigerating compartment 12 can be introduced through the suction port 172*a* at the lower end of the rear cover 17.

Air introduced into the space behind the rear cover 17 through the suction port 172*a* can flow upward. In some implementations, the blowing fan 511 can be located above the evaporator 31, and the inlet 537 through which air flows into the blowing fan 511 can be opened forward.

For example, air flowing backward through the suction port 172*a* can flow forward again in the process of flowing to the upper suction port 172*a*, and can pass while traversing the evaporator 31 from the rear to the front. That is, air flows in the entire region before and after the evaporator 31 and heat exchange can be performed. Through the formation of such a passage, the heat exchange efficiency of the evaporator 31 can be improved and the cooling performance can be further improved.

In some implementations, when the inlet through which cold air flows toward the blowing fan is opened backward, air flowing backward through the suction port 172*a* will flow directly upward along the rear end of the evaporator 31 and flow into the inlet. Therefore, since the flow of air does not occur in a partial region of the first half of the evaporator 31, heat exchange efficiency can be relatively low.

In some implementations, cold air flowing in the process of introducing the cold air into the inlet 537 can be concentrated on the rear surface of the rear cover 17, but heat insulation can be reinforced by the heat insulation material 173, thereby limiting the front of the rear cover 17 from being locally supercooled.

Referring to FIGS. 17 and 18, the blowing fan 511 can discharge air in the circumferential direction while rotating in the counterclockwise direction. The second passage 42 can be provided in the direction of air discharged by the blowing fan 511, and the second passage 42 can be provided to have an inlet larger than the diameter of the blowing fan 511.

Therefore, a sufficient amount of cold air can be supplied to the second passage 42. The first passage 41 can be located at a position farther in the rotation direction of the blowing fan 511 than the second passage 42 and can extend upward. Further, the width D1 of the entrance of the first passage 41 can be provided to be narrower than the width D2 of the entrance of the second passage 42. Therefore, the amount of cold air flowing into the first passage 41 can be relatively smaller than the amount of cold air flowing into the second passage 42.

Cold air flowing along the first passage 41 can be discharged forward through the cold air discharge port 171*a* to cool the refrigerating compartment 12. The cold air introduced into the second passage 42 can flow upward along the second passage 42. Part of cold air flowing along the second passage 42 can be discharged forward through the cold air discharge port 171*a* to cool the refrigerating compartment 12.

In some implementations, the remaining part of the cold air flowing along the second passage 42 can be supplied to the door storage space 251 through the door supply duct 16 to cool the door storage space 251.

For example, since the second passage 42 is branched into the main passage 421 and the sub-passage 422, the cold air flowing through the main passage 421 can supply cold air to the refrigerating compartment 12. The cold air flowing through the sub-passage 422 can be introduced into the door supply duct 16 coupled to the sub-passage 422, can be introduced along the door supply duct 16, and can be then supplied to the door storage space 251.

In some implementations, a defrosting operation can be performed in order to limit the cooling efficiency from deteriorating due to frost formation on the evaporator 31 and the passage through which the cold air flows.

Hereinafter, the structure for guiding the discharge of defrost water generated during the defrost operation and the flow of cold air will be described with reference to the drawings.

Figure 20:
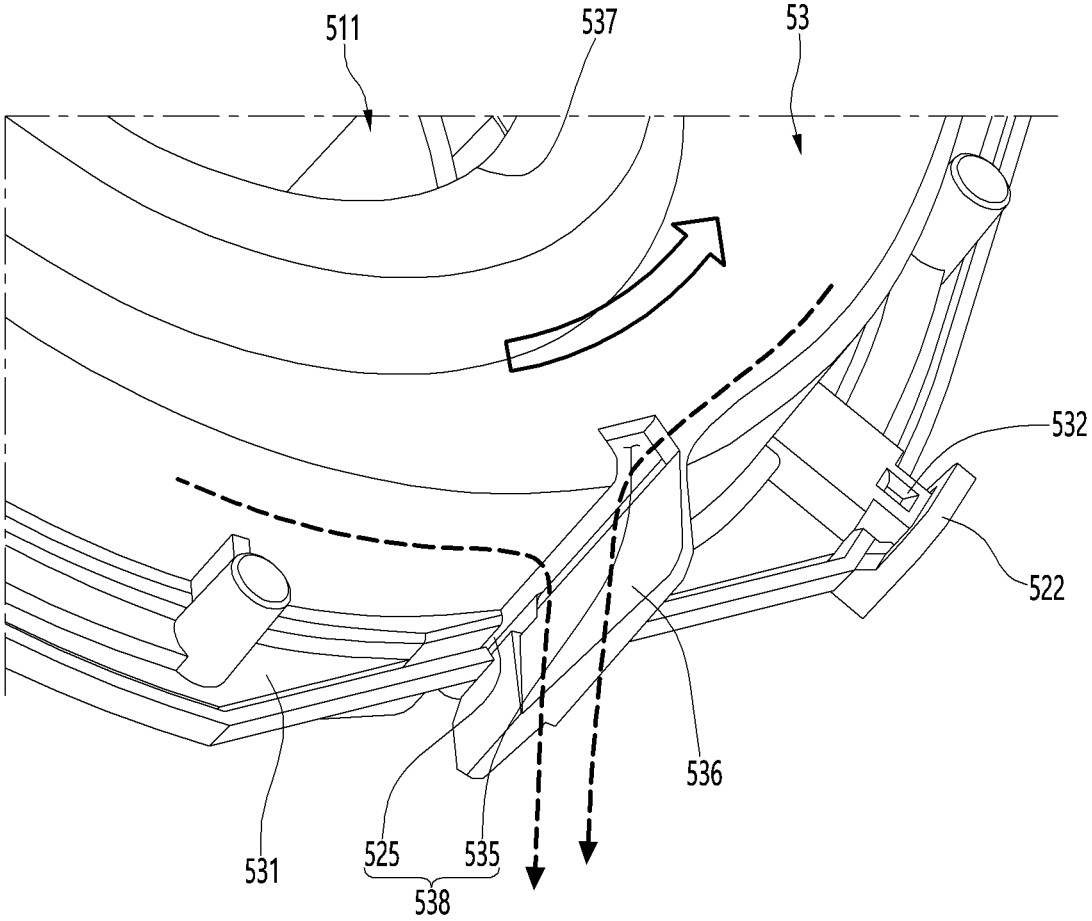
FIG. 20 is a diagram illustrating an enlarged view of a portion A of FIG. 19.
Figure 21:
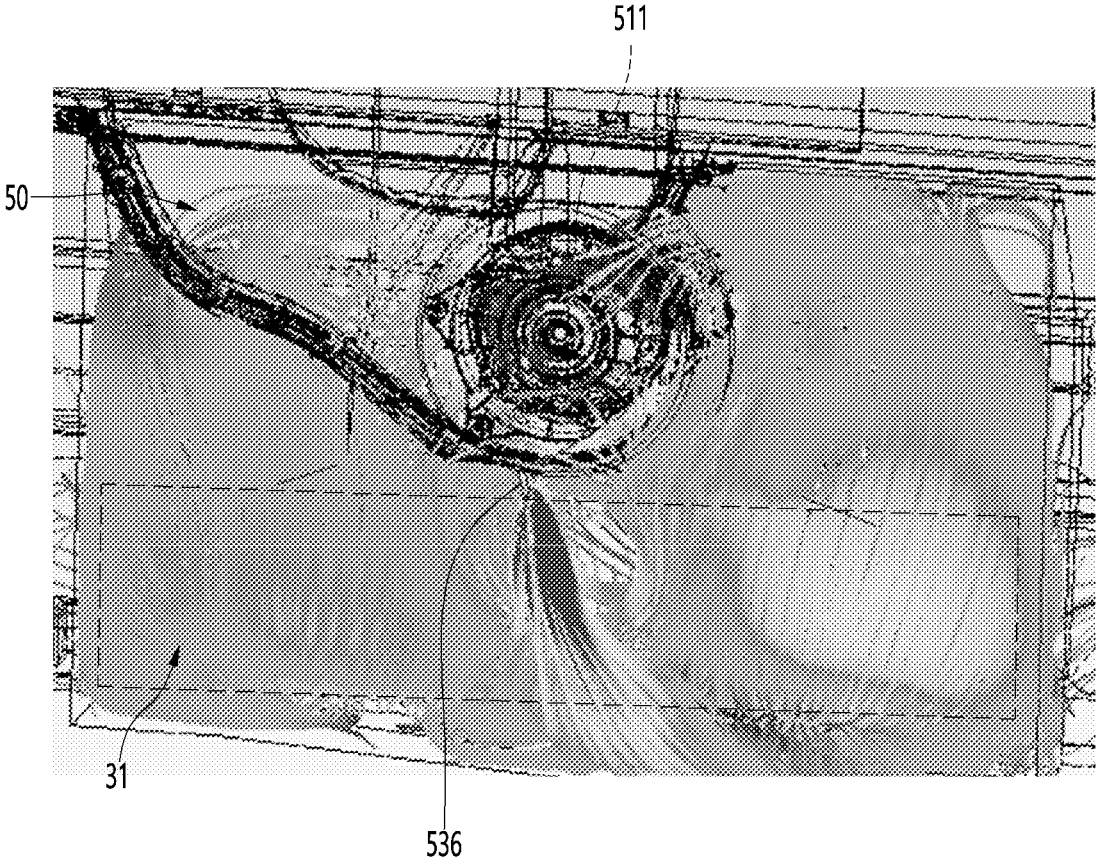
FIG. 21 is a simulation diagram illustrating a state of air flow in an evaporator region.

FIG. 19 is a diagram illustrating a structure of air flow and defrost water discharge of the fan motor assembly. FIG. 20 is an enlarged view of a portion A of FIG. 19. FIG. 21 is a simulation diagram illustrating a flow state of air in the evaporator region.

As shown in the drawing, the evaporator 31 can be provided in the storage space, that is, the inner floor of the refrigerating compartment 12. A defrost heater 313 can be provided at the lower end of the evaporator 31. The defrost heater 313 can be provided in a wire shape, and can be configured to be bent along the lower end of the evaporator 31. The defrost heater 313 can be configured as a sheath heater, and can be operated during the defrost operation to remove frost on the evaporator 31 and the passage through which the cold air flows.

During the defrosting operation, heat generated by the defrost heater 313 can remove the frost on the evaporator 31, and the frost on the inside of the fan motor assembly 50 and the passage can be melted. In some implementations, a drain pan 60 and a pipe for discharging defrost water can be further provided below the evaporator 31. Therefore, water falling from the fan motor assembly 50 and water flowing downward from the evaporator 31 can be discharged to the outside of the storage space by the defrost operation.

In some implementations, the fan motor assembly 50 can be disposed above the evaporator 31. The inlet 537 and the blowing fan 511 of the fan motor assembly 50 can be located in the center with respect to the left and right direction of the evaporator 31. Therefore, cold air can flow evenly in the entire region of the evaporator 31.

The bottom hole 538 and the discharge guide 536 for discharging defrost water can be provided at the lower end of the fan motor assembly 50. The bottom hole 538 and the discharge guide 536 can be provided on the lower surface of the fan motor assembly 50. The bottom hole 538 and the discharge guide 536 can be located in the circumferential direction of the blowing fan 511.

For example, the bottom hole 538 can be provided in the front housing 53 and the rear housing 52, and can include the front bottom hole 535 and the rear bottom hole 525. That is, the front bottom hole 535 and the rear bottom hole 525 can be coupled to each other by the coupling of the front housing 53 and the rear housing 52, and the bottom hole 538 can be defined.

The bottom hole 538 can be located at the lowest position of the front housing 53 and the rear housing 52. Therefore, water flowing along the front housing 53 and the rear housing 52 can fall downward by the bottom hole 538.

The bottom hole 538 can be located above the center of the evaporator 31, such that defrost water falling from the evaporator 31 can be limited from falling on one side of the left and right sides of the evaporator 31.

The bottom hole 538 can be located in the center with respect to the left and right direction of the evaporator 31. The bottom hole 538 can be located in a region vertically downward between the left and right sides of the blowing fan 511. For example, the bottom hole 538 can be located below the region of the blowing fan 511 and can be affected by air blown by the blowing fan 511. The discharge guide 536 provided at one side of the bottom hole 538 can also be disposed at the same position.

The discharge guide 536 can extend downwardly along the outer end of the bottom hole 538. The discharge guide 536 can extend from one of the front housing 53 and the rear housing 52. In some implementations, the discharge guide 536 can be partially provided in the front housing 53 and the rear housing 52. The front housing 53 and the rear housing 52 can be coupled to each other.

The discharge guide can extend downward from one end of the bottom hole 538. For example, the bottom hole 538 can extend downward from the right end adjacent to the second guide part 55 between both left and right sides of the bottom hole 538.

The discharge guide 536 can extend obliquely. The discharge guide 536 can be provided to face the left side to be extended downward. For example, the extending direction of the discharge guide 536 can extend in a direction opposite to the rotation direction of the blowing fan 511.

That is, when the blowing fan 511 is driven, the air inside the evaporator 31 can be suctioned through the inlet and can be directed toward the circumferential direction of the blowing fan 511. In some implementations, the blowing fan 511 can rotate counterclockwise, and air flowing in the circumferential direction of the blowing fan 511 can be discharged while rotating in the counterclockwise direction that is the same as the rotation direction of the blowing fan 511.

Therefore, air discharged from the blowing fan 511 can smoothly flow along the second guide part 55 due to the characteristics of the shape of the second guide part 55 extending upward after extending to the right.

In some implementations, since the discharge guide 536 extends in a direction opposite to the flow direction of the air discharged from the blowing fan 511, air flowing in the inside of the fan motor assembly 50 can flow in a direction crossing the discharge guide 536. Therefore, air flowing through the fan motor assembly 50 can be blocked by the discharge guide 536 in the bottom hole 538, and thus, the discharge of the air to the outside can be restricted.

For example, since the discharge guide 536 is provided in a direction crossing the air flow direction inside the fan motor assembly 50, the flow of air introduced through the bottom hole 538 can be blocked. When the discharge guide 536 extends in the same direction as the flow direction of air discharged by the blowing fan 511, air can be discharged downward through the bottom hole 538 by facilitating the flow of air passing through the bottom hole 538.

Due to the downward air discharge, the flow of air toward the inlet 537 in the region of the evaporator 31 can be blocked. Therefore, the flow of air can be reduced in part of the right region of the evaporator 31, resulting in a partial increase in frost formation.

However, the discharge guide 536 extends in a direction opposite to the flow direction of the air discharged by the blowing fan 511, that is, the rotation direction of the blowing fan 511, and thus, air discharged through the bottom hole 538 can be minimized.

Therefore, as shown in FIG. 21, the air having passed through the bottom hole 538 flows out only to the central portion of the evaporator 31, and the entire flow of air in the evaporator 31 is not disturbed. The evaporator 31 can be directed toward the inlet 537 in a state in which the flow of air on the left and right sides is balanced as a whole. Therefore, it is possible to limit excessive frost formation in a specific region of the evaporator 31, thereby limiting adverse effects on the supply of cold air or problems in defrosting operation.

In some examples, when it is determined that the defrost operation is required while the refrigerator 1 is being operating, the defrost heater 313 can be operated to melt the frost inside the evaporator 31 and the fan motor assembly 50. Defrost water or condensed water generated inside the fan motor assembly 50 flows downward, and falls down to the bottom of the storage space through the bottom hole 538 located at the lower end. In this case, defrost water or condensed water having passed through the bottom hole 538 can be discharged with directionality through the discharge guide 536. As an example, the discharge guide 536 can be directed toward a portion where the defrost water is discharged on the bottom of the storage space so as to facilitate the discharge of the defrost water, and it is possible to limit water from scattering in the region of the evaporator 31 and being widely stained.

The following effects can be expected from the refrigerator 1.

The duct assembly can include the first passage and the second passage, and can be configured to guide cold air into the storage space. The second passage can be branched into the main passage and the sub-passage to supply cold air to the door supply duct communicating with the door storage space.

In some implementations, the second passage can have a structure in which a large amount of cold air can be introduced and flowed compared to the first passage. Therefore, there is an advantage of effectively cooling the storage space by supplying sufficient cool air to the door storage space as well as the storage space.

In order to further supply cold air to the second passage, the first guide part and the second guide part coupled to the first passage and the second passage can be provided in the fan motor assembly. The width of the entrance of the second guide part coupled to the second passage can be greater than the width of the entrance of the first guide part, such that a sufficient amount of cold air can be supplied through the second passage.

In addition, the blowing fan can rotate in a direction in which the blown air passes through the second guide part and then passes through the first guide part. Therefore, when the blowing fan rotates, more cold air can be introduced into the second guide part.

For example, the second guide part can have an inlet width greater than the diameter of the blowing fan, and the blowing fan can be located between the upper and lower ends of the second guide part, such that a larger amount of cold air can be effectively supplied to the second guide part and the second passage when the blower fan is driven.

The fan motor assembly can be provided at the lower end of the duct assembly. The inlet of the fan motor assembly can be provided to face the front, such that the cold air discharged in the circumferential direction by the blowing fan can straighten the passage toward the duct assembly. The flow of cold air can be made more effective.

For example, the first coupling part and the second coupling part can protrude from the upper ends of the first guide part and the second guide part, and the first stepped part and the second stepped part can be provided at the lower ends of the first passage and the second passage of the duct assembly, such that the first coupling part and the second coupling part can be seated on the first stepped part and the second stepped part, respectively. Therefore, while the duct assembly and the fan motor assembly are firmly coupled to each other, the upper ends of the first guide part and the second guide part and the lower ends of the first passage and the second passage can form the same plane, thereby achieving more efficient flow of cold air.

Due to the straightening of the passage and the flow improvement, improvement in noise generated during air flow, improvement in cooling performance due to efficient flow of cold air, and power consumption reduction effects can be expected.

The heat insulation material can be disposed on the rear surface of the rear cover in order to limit the rear cover facing the inlet from being locally supercooled because the inlet is formed to face the front. Therefore, there is an advantage of improving the flow of the cold air and preventing local supercooling of the storage space.

Since the inlet faces forward, the cold air introduced into the fan motor assembly through the evaporator can evenly pass through the entire region of the first half and the second half of the evaporator in the process of passing through the evaporator. Therefore, the effect of improving heat exchange efficiency and cooling performance can be expected.

Since the bottom hole through which defrost water or water generated during condensation may be discharged is formed at the lower end of the fan motor assembly, defrost water or water generated during condensation can be effectively discharged to the outside of the fan motor assembly.

In addition, the discharge guide extending downward can be provided at the end of the bottom hole, such that defrost water falling downward can be guided to a specific position without scattering, thereby discharging the defrost water more effectively.

For example, the discharge guide can extend in a direction opposite to the rotation direction of the blowing fan. Therefore, the discharge guide can reduce the amount of air flowing inside the fan motor assembly passing through the bottom hole when the blowing fan is driven.

Through such a structure, it is possible to minimize disturbance of the flow of cold air on the evaporator side due to interference with air discharged through the bottom hole while the cold air from the evaporator below the fan motor assembly is introduced into the inlet. That is, there is an advantage of smoothly discharging defrost water inside the fan motor assembly and smoothly flowing cold air flowing into the fan motor assembly from the evaporator side.

By allowing the smooth flow of air from the evaporator side, air flows smoothly from the entire left and right sides of the evaporator to the fan motor assembly, thereby increasing the heat transfer efficiency of the evaporator.

In addition, by allowing the smooth flow of air throughout the evaporator, it is possible to limit air congestion in the region adjacent to the evaporator and it is possible to limit frost formation on the evaporator surface and growth of frost.

In addition, even during the defrost operation, frost can be evenly distributed throughout the evaporator to limit the formation of local non-defrost section after the defrost operation. Furthermore, there is an advantage of limiting the defrost heater from being driven for a long time, thereby improving cooling efficiency and reducing power consumption.

What is claimed is:

1. A refrigerator comprising:

a cabinet defining a storage space;

a door configured to open or close the storage space;

an evaporator configured to supply cold air to the storage space;

a duct assembly provided above the evaporator, extending in a vertical direction, and configured to guide the cold air supplied to the storage space;

a door supply duct coupled to the duct assembly and configured to guide a part of the cold air flowing through the duct assembly to be supplied to the door;

a fan motor assembly that is coupled to a lower end of the duct assembly and configured to suction air cooled by the evaporator and to blow the suctioned air into the duct assembly, the fan motor assembly comprising (i) a fan module including a blowing fan that is configured to suction the cold air and (ii) a front housing and a rear housing that accommodate the fan module; and a rear cover that defines a rear wall surface of the storage space and covers the evaporator, the fan motor assembly, and the duct assembly, the rear cover including (i) a suction port configured to receive the cold air from the storage space and (ii) a plurality of discharge ports configured to supply the cold air to the storage space, wherein the front housing defines an inlet that is open forward toward a rear surface of the rear cover and configured to introduce the cold air to the blowing fan, the inlet being spaced apart from the rear surface of the rear cover, wherein the refrigerator further comprises a heat insulation material that is disposed on the rear surface of the rear cover and faces the inlet of the front housing in a front-rear direction, wherein the blowing fan is configured to rotate to thereby inhale the cold air from a front side of the blowing fan and to discharge the cold air in a radial direction of the blowing fan, wherein the duct assembly defines a first passage and a second passage that are spaced apart from each other, wherein the second passage comprises:

a main passage configured to supply the cold air to the storage space, and a sub-passage branched from the main passage and coupled to the door supply duct, wherein, based on the cold air being supplied to the second passage, a flow rate of the cold air supplied through the second passage is greater than a flow rate of the cold air supplied through the first passage, wherein the front housing and the rear housing are coupled to each other and include (i) a first guide part configured to guide cold air discharged from the blowing fan to the first passage and (ii) a second guide part configured to guide the cold air discharged from the blowing fan to the second passage, wherein a width of an entrance of the second guide part is greater than a width of an entrance of the first guide part, wherein the first guide part extends upward from an upper side of the blowing fan and is located at an extension line of the vertical direction passing through a center of the blowing fan, wherein the second guide part extends upward from a side of the blowing fan facing the second passage, wherein the fan motor assembly defines a bottom hole that is opened toward the evaporator such that defrost water is discharged, wherein the fan motor assembly further comprises a discharge guide that extends obliquely downward from a first end of the bottom hole and is configured to guide the defrost water discharged through the bottom hole, wherein the evaporator comprises:

a plurality of cooling fins, and a refrigerant pipe that extends in a horizontal direction and passes through the plurality of cooling fins, the refrigerant pipe being bent a plurality of times and configured to carry a refrigerant therein, and wherein an upper part of the refrigerant pipe is located below the fan motor assembly and comprises:

a first portion that faces the first guide part and passes through first fins among the plurality of cooling fins, a second portion that faces the second guide part and passes through second fins among the plurality of cooling fins, and a third portion that is located between the first portion and the second portion and faces the discharge guide, the third portion passing through none of the plurality of cooling fins.

2. The refrigerator according to claim 1, wherein a volume of the first passage is less than a volume of the second passage.

3. The refrigerator according to claim 1, wherein the door comprises:

a main door that is configured to rotate to open or close the storage space, that defines an opening, and that includes a door accommodation member defining a door storage space accessible through the opening; and a sub-door provided in front of the main door and configured to rotate to open or close the opening, and wherein a rear end of the door supply duct is coupled to the sub-passage, and a front end of the door supply duct is in communication with the door accommodation member in a state in which the main door is closed.

4. The refrigerator according to claim 3, wherein the door supply duct is provided on an upper surface of the storage space.

5. The refrigerator according to claim 3, wherein the first passage and the second passage are respectively disposed on a left side and a right side with respect to a center of the storage space, and wherein the second passage faces the door accommodation member.

6. The refrigerator according to claim 1, wherein the rear housing defines (i) a first space in which the fan module is accommodated and (ii) a second space configured to guide cold air toward the duct assembly.

7. The refrigerator according to claim 1, wherein the width of the entrance of the second guide part is greater than a diameter of the blowing fan.

8. The refrigerator according to claim 1, wherein an upper end of the fan motor assembly comprises:

a first housing outlet that defines an opened upper surface of the first guide part and that is coupled to an opened lower end of the first passage; and a second housing outlet that defines an opened upper surface of the second guide part and that is coupled to an opened lower end of the second passage, wherein an area of the second housing outlet is greater than an area of the first housing outlet.

9. The refrigerator according to claim 1, further comprising a drain pan provided on a bottom surface of the storage space and configured to discharge the defrost water to an outside of the storage space, wherein the discharge guide extends toward the drain pan.

10. The refrigerator according to claim 1, wherein the discharge guide extends in a direction opposite to a rotation direction of the blowing fan.

11. The refrigerator according to claim 1, wherein the bottom hole is located below and between left and right ends of the blowing fan.

12. The refrigerator according to claim 1, wherein the discharge guide extends from the first end of the bottom hole that is located closer to the second guide part than to the first guide part.

13. The refrigerator according to claim 12, wherein the discharge guide extends obliquely in a direction away from the second guide part as the discharge guide extends downward.

14. The refrigerator according to claim 12, wherein the bottom hole and the discharge guide are located at a position closer to the second guide part compared to the first guide part with respect to a vertical extension line passing through the center of the blowing fan.

15. The refrigerator according to claim 1, wherein the heat insulation material is spaced apart from the inlet of the front housing in the front-rear direction to thereby define a space configured to provide the cold air toward the inlet of the front housing.

16. The refrigerator according to claim 1, wherein the rear cover comprises:

an upper rear cover that covers the duct assembly; and a lower rear cover that extends downward from a lower portion of the upper rear cover and covers the evaporator and the fan motor assembly, the lower rear cover facing the inlet of the front housing in the front-rear direction, and wherein the heat insulation material is attached to the lower rear cover.

17. The refrigerator according to claim 16, wherein the lower rear cover protrudes forward in the front-rear direction relative to the upper rear cover to thereby accommodate the front side of the blowing fan.

18. The refrigerator according to claim 1, wherein the heat insulation material comprises a vacuum heat insulation material.

19. The refrigerator according to claim 1, wherein the heat insulation material defines a sheet structure.

* * * * *